US012281454B2

(12) United States Patent
Watson

(10) Patent No.: US 12,281,454 B2
(45) Date of Patent: Apr. 22, 2025

(54) AUTOMATIC PILOT VALVE SYSTEM FOR FOUNDATION TOOLING

(71) Applicant: Richard W. Watson, Lakeside, CA (US)

(72) Inventor: Richard W. Watson, Lakeside, CA (US)

( * ) Notice: Subject to any disclaimer, the term of this patent is extended or adjusted under 35 U.S.C. 154(b) by 184 days.

(21) Appl. No.: 18/504,278

(22) Filed: Nov. 8, 2023

(65) Prior Publication Data

US 2024/0191452 A1 Jun. 13, 2024

Related U.S. Application Data

(60) Provisional application No. 63/431,785, filed on Dec. 12, 2022.

(51) Int. Cl.
*E02D 5/04* (2006.01)
*E02D 3/12* (2006.01)
*E02D 15/04* (2006.01)

(52) U.S. Cl.
CPC ..... *E02D 15/04* (2013.01); *E02D 3/12* (2013.01)

(58) Field of Classification Search
CPC ..... E02D 15/04; E02D 3/12; E02D 2500/003; E02D 5/36; E21B 33/13
See application file for complete search history.

(56) References Cited

U.S. PATENT DOCUMENTS 3,690,109 A * 9/1972 Turzillo ..... E02D 5/36 405/241
3,869,869 A * 3/1975 Pao Chen ..... E02D 5/385 405/240
4,074,735 A * 2/1978 McCabe ..... E02D 3/12 405/269
4,158,518 A * 6/1979 Rusche ..... E02D 15/04 405/242
5,176,219 A * 1/1993 Cole ..... E21B 34/12 175/21
6,079,906 A * 6/2000 Herrero Codina ..... E02D 5/385 175/21
7,726,913 B1 * 6/2010 Sjogren ..... E02D 5/385 166/334.4
8,152,415 B2 * 4/2012 Fox ..... E02D 5/44 405/255

(Continued)

*Primary Examiner* — Benjamin F Fiorello
(74) *Attorney, Agent, or Firm* — Richard D. Clarke

(57) ABSTRACT

The present application is directed to an automatic pilot valve (APV) system for foundation tooling, such as a continuous flight auger (CFA) or displacement tool structured to include a pilot tip receiving housing in communication with a cement supply in which when the pilot tip is in the retracted position while drilling operations are being performed, the pilot tip shaft blocks the flow of cement into the drilled hole. When the APV equipped CFA is being lifted out of the drilled hole, the APV pilot shaft slides outwardly simultaneously exposing one or more cement ports allowing cement to flow. The APV can include a one-piece machined, cast or forged valve housing, or manufactured by welding steel components into a multi-piece valve housing. The APV can be deployed externally by attachment to the outside of foundation or displacement tool stems or internally by installation inside of foundation or displacement tool stems.

20 Claims, 16 Drawing Sheets

(56) References Cited

U.S. PATENT DOCUMENTS

| | | | | |
|---|---|---|---|---|
| 2009/0211811 | A1* | 8/2009 | Roussy | E21B 10/64 175/57 |
| 2014/0126960 | A1* | 5/2014 | Green | E02B 11/005 405/36 |
| 2016/0305084 | A1* | 10/2016 | Steff De Verninac | E02D 17/13 |
| 2022/0145567 | A1* | 5/2022 | Saidel | E02D 15/04 |

* cited by examiner

AUTOMATIC PILOT VALVE SYSTEM FOR FOUNDATION TOOLING

FIELD OF THE INVENTION

This application relates to an Automatic Pilot Valve (APV) System for Foundation Tooling and its use on foundation drilling machines. More particularly, provided is an automatic pilot valve system for foundation tooling, such as a continuous flight auger (CFA), or displacement tool structured to include a drill pilot tip receiving housing in fluid communication with a cement source pipe opening in which when the pilot tip is in the retracted position while drilling operations are being performed, the pilot tip shaft blocks the flow of cement into the drilled hole. Then, when the CFA is being lifted out of the drilled hole, the APV pilot tip shaft slides outwardly simultaneously exposing one or more cement port orifices which allow cement to flow into the drilled hole. The automatic pilot valve system for foundation tooling is configured to accept and secure any number of various pilot tip shafts and can be constructed by being machined or forged resulting in a two-piece APV, or manufactured by welding the commonly available steel components into the desired size and configuration, resulting in a manufactured multi-piece automatic pilot valve system for foundation tooling. The APV can be deployed externally, that is, attached to the outside of foundation tool stems or the APV can be installed internally by being attached to the inside of foundation tool stems.

BACKGROUND OF THE INVENTION

Auger Cast drilling, also known as Continuous Flight Auger (CFA) drilling, is a technique used in construction to create a concrete deep foundation. Continuous flight auger has been used in the United Kingdom since 1966, but its use is relatively new in the United States. A continuous flight auger drill is used to excavate a hole and cement is injected through a hollow shaft under pressure as the auger is extracted. Reinforcement is sometimes inserted after the auger is removed. This creates a continuous pile without ever leaving an open hole.

A continuous flight auger (CFA) is a type of drilling tool used in construction and civil engineering projects. It is commonly used for creating deep foundation piles, such as bored piles or drilled shafts. Displacement CFA piles use a similar technique and are designed to compact the soil in the hole to reduce the amount of dirt that needs to be moved off the jobsite. All foundation techniques and tools that inject cement into the hole will be greatly improved with the APV system.

The CFA consists of a hollow stem, typically made of steel, with helical flights or spirals along its length. These flights are similar to those found on a screw, hence the name "auger." The auger is attached to a drilling rig, and as it rotates, it advances into the ground while simultaneously extracting soil or other materials.

The drilling process with a continuous flight auger involves the following steps:

- Auger insertion: The auger is placed on the ground at a designated location. Then a temporary plug is installed, or a door is reset by a worker to prevent soil from plugging the inner concrete pipe exit port. The drilling rig begins rotating the auger. The auger's helical flights help to advance it into the ground.

- Soil extraction: As the auger rotates, the flights transport the excavated soil up to the surface. This continuous process allows for efficient removal of soil during drilling.
- Concrete placement: Once the desired depth is reached, the auger is gradually withdrawn while simultaneously pumping concrete through the hollow stem to the tip of the auger. The concrete fills the void left by the auger, forming a solid foundation pile. Continuous flight augers offer several advantages in foundation construction. They are well-suited for drilling in cohesive soils, non-cohesive soils, and mixed soil conditions. The continuous placement of concrete as the auger is slowly rotated and lifted minimizes the risk of soil collapse or caving of the hole. Additionally, the auger's helical flights help to improve the integrity of the pile by ensuring consistent concrete placement along the entire length of the drilled shaft.

Overall, the use of continuous flight augers provides a relatively fast and efficient method for creating deep foundation piles, making them a popular choice in various construction projects.

A continuous flight auger (CFA) is constructed using a combination of steel components. Here are the main parts that make up a conventional CFA:

- Auger Stem: The auger stem is the main body of the CFA. It is typically a hollow steel pipe with a uniform diameter along its length. The diameter can vary depending on the specific application and design requirements.
- Inner Concrete Pipe: The inner concrete pipe is located at the center of the Auger Stem and is used to transport pressurized concrete from the drill rig to the tip of the auger.
- Inner Concrete Pipe Exit Port: The inner concrete pipe exit port connects the inner concrete pipe to a hole in the side of the Auger Stem and allows the concrete to exit the auger near the tip of the auger.
- Inner Concrete Pipe Exit Port Plug or Door: The inner concrete pipe exit port plug or door provides a temporary seal to prevent soil from entering the inner concrete pipe when drilling and opens when the weight, or pressure of the concrete forces it out, or open. These plugs and doors often fall out or get ripped off while drilling as the soil and rocks hit them. This unfortunately allows the inner cement pipe to get plugged with soil and forces the workers to stop production and remove the auger from the hole so it can be unplugged. These temporary seals need to be re-installed or reset by a worker before each hole is drilled. This time-consuming practice is very unsafe as soil, rocks and concrete often fall off the augers from great heights and can injure workers as they install new plugs, reset the doors, or replace the broken doors.
- Auger: The auger flights are spiral-shaped blades that run along the length of the auger stem. These flights are responsible for cutting into the ground and transporting excavated material upward. They are typically welded or attached to the outer surface of the auger stem. The flights can have different shapes and configurations, such as single, double, or triple helix.
- Auger Tip: The auger Tip is the part of the CFA that comes into direct contact with the ground first. It is designed to penetrate the soil or rock and break it up as the auger rotates. The shape and design of the auger tip can vary depending on the specific ground conditions and the desired drilling outcome.

Couplers: Couplers are used to connect multiple sections of the auger stem together, allowing for the extension of the CFA to reach greater depths. These couplers provide a secure connection between adjacent sections of the auger stem.

Drive Mechanism: The CFA is connected to a drilling rig that provides the rotational force required for the auger to penetrate the ground. The drive mechanism can vary depending on the type of drilling rig being used, but it generally involves a hydraulic motor or a similar power source.

Concrete Pumping System: In CFA drilling, a concrete pumping system is used to simultaneously pump concrete through the inner concrete pipe of the auger while it is being withdrawn from the ground. This ensures a continuous flow of concrete into the drilled shaft, filling the void left by the auger and forming a solid foundation pile.

It's important to note that the specific construction details of a continuous flight auger can vary depending on the manufacturer and the project requirements. The size, shape, and configuration of the auger stem, flights, and other components can be customized to suit different drilling conditions and applications.

A continuous flight auger (CFA) operates by using rotational motion to penetrate the ground, extract soil or other materials, and facilitate the installation of foundation piles. Here is a step-by-step overview of how a conventional CFA typically operates:

Auger insertion: The auger is placed on the ground at a designated location. Then a temporary plug is installed, or door is reset by a worker to prevent soil from plugging the inner concrete pipe exit port. The drilling rig begins rotating the auger. The auger's helical flights help to advance it into the ground.

Penetration and Soil Extraction: As the auger rotates, the helical flights or spirals along its length cut into the ground. The design of the flights facilitates the extraction of soil or other materials from the borehole. The excavated material is transported upward and out of the hole.

Continuous Drilling: The drilling process is continuous, with the auger steadily advancing into the ground as the soil is extracted. The rotational speed and downward pressure applied by the drilling rig are adjusted to ensure effective drilling progress and proper soil removal.

Concrete Placement: When the desired depth is reached, the auger is gradually withdrawn while concrete is simultaneously pumped through the hollow stem. The concrete fills the void left by the auger, forming a solid foundation pile. As previously mentioned, the inner concrete pipe exit port allows pumped concrete to flow out and into the hole. This concrete pipe exit port is initially plugged. The plug or door, often made from cork, provides a temporary seal to prevent soil from entering the inner concrete pipe when drilling down and opens when the weight, or pressure of the concrete forces it out, or to open when the CFA is lifted out of the drilled hole. These plugs and doors often fall out or get ripped off while drilling as the soil and rocks hit them. Unfortunately, this allows the inner cement pipe to get plugged with soil and forces the workers to stop production and remove the auger from the hole so it can be manually unplugged. These temporary seals need to be re-installed or reset by a worker before each hole is drilled. This time-consuming practice is very unsafe for the workers, as soil, rocks and concrete often fall off the augers from great heights and can injure workers as they install new plugs or reset the doors.

In this regard, there is a long felt need for an automatic pilot valve system for foundational tooling for use in drilling with a CFA rig, to replace these conventional concrete pipe exit port plugs and doors which both fail, and create an unsafe working environment.

Reinforcement (if necessary): Depending on the design requirements, reinforcement elements such as steel reinforcing bars or cages may be inserted into the freshly poured concrete to provide additional strength and stability to the foundation pile.

Completion and Repeated Process: Once the concrete has been placed and any necessary reinforcement has been installed, the drilling of that particular pile is complete. The process can then be repeated for subsequent piles until the desired foundation configuration is achieved. It's worth noting that the specific operating parameters, such as rotational speed, penetration rate, and concrete pumping rate, may vary depending on factors such as soil conditions, pile design requirements, and the capabilities of the drilling equipment being used. These parameters are typically determined by experienced operators and engineers to ensure the successful installation of foundation piles using the CFA method.

In this respect, before explaining at least one embodiment of the Automatic Pilot Valve (APV) System for Foundation Tooling in greater detail, it is to be understood that the design is not limited in its application to the details of construction and to the arrangement of the components set forth in the following description or illustrated in the drawings. The Automatic Pilot Valve (APV) System for Foundation Tooling is capable of other embodiments and of being practiced and carried out in various ways. Also, it is to be understood that the phraseology and terminology employed herein are for the purpose of description and should not be regarded as limiting.

SUMMARY OF THE INVENTION

The preferred embodiment of the Automatic Pilot Valve (APV) System for Foundation Tooling comprises a continuous flight auger (CFA) APV housing structured to include a pilot tip housing channel in fluid communication with a cement source pipe opening in which when the pilot tip is in the retracted position while drilling operations are being performed, the pilot tip shaft blocks the flow of cement into the drilled hole. Then, when the CFA is being lifted out of the drilled hole, the pilot tip shaft slides outwardly simultaneously exposing one or more cement port orifices which allow cement to flow into the drilled hole. The CFA APV housing is configured to accept and secure any number of various pilot tip shafts and can be constructed by being machined or forged, resulting in a one-piece APV housing, or manufactured by welding the commonly available steel components into the desired size and configuration, resulting in a manufactured multi-piece APV housing.

The primary advantage of the Automatic Pilot Valve System for Foundation Tooling is that it improves production efficiency, saves time and money, and drastically improves safety while in operation, even in difficult ground drilling conditions.

Another advantage of the Automatic Pilot Valve System for Foundation Tooling is that it significantly decreases equipment downtime and repair time.

Yet another advantage of the Automatic Pilot Valve System for Foundation Tooling is that it can be structured to be stronger, and because of this stronger configuration, it will not break off or tear off as do prior art continuous flight auger port doors and plugs.

A further advantage of the Automatic Pilot Valve System for Foundation Tooling is that it can be constructed as a two-piece valve using metallurgical forging, casting, or machining techniques.

Another advantage of the Automatic Pilot Valve System for Foundation Tooling is that it can be constructed by welding common steel components.

Yet another advantage of the Automatic Pilot Valve System for Foundation Tooling is that it significantly reduces on the job accidents and injuries because the coupler stem automatically closes and prevents concrete from flowing out while drilling.

A further advantage of the Automatic Pilot Valve System for Foundation Tooling is that it significantly improves safety of workers in proximity to the units as no worker need to be near an open hole and other hazardous areas to install prior art single use concrete flow cork plugs or close and secure prior art concrete flow doors.

Another advantage of the Automatic Pilot Valve System for Foundation Tooling is that it resets automatically so that no worker has to be under the auger with falling dirt and rocks from above always possible.

Another advantage of the Automatic Pilot Valve System for Foundation Tooling is that it enables fast and easy installation and replacement of drill heads required for differing job conditions.

Yet another advantage of the Automatic Pilot Valve System for Foundation Tooling is that it allows for one man operation, the operator simply sets the pilot tip on the ground and the APV automatically closes so the operator can start drilling.

A further advantage of the present APV system is that it is structured to and configured for being applied to numerous and various types of foundation tools and displacement tools including CFA's, displacement CFA's, micro-piles, and many others, all of which use similar techniques and similarly configured tools to inject cement into foundation holes.

Yet a further advantage of the Automatic Pilot Valve System for Foundation Tooling is that it prevents waste by eliminating thousands of prior art cork plugs left in every hole drilled and filled with concrete, and in this way, saves the source of cork, namely, cork trees.

These together with other advantages of the Automatic Pilot Valve System for Foundation Tooling, along with the various features of novelty, which characterize the design are pointed out with particularity in the claims annexed to and forming a part of this disclosure. For a better understanding of the Automatic Pilot Valve System for Foundation Tooling its operating advantages and the specific objects attained by its uses, reference should be made to the accompanying drawings and descriptive matter in which there are illustrated the preferred and alternate embodiments of the Automatic Pilot Valve System for Foundation Tooling. There has thus been outlined, rather broadly, the more important features of the design in order that the detailed description thereof that follows may be better understood, and in order that the present contribution to the art may be better appreciated. There are additional features of the Automatic Pilot Valve System for Foundation Tooling that will be described hereinafter, and which will form the subject matter of the claims appended hereto.

The preferred embodiment of the Automatic Pilot Valve (APV) System for Foundation Tooling will have a continuous flight auger (CFA) APV housing structured to include a pilot tip receiving channel in fluid communication with a cement source pipe opening in which when the pilot tip is in the retracted and closed position while drilling operations are being performed, the pilot tip shaft blocks the flow of cement into the drilled hole. Then, when the CFA is being lifted out of the drilled hole, the pilot tip shaft within the APV system slides outwardly simultaneously exposing one or more cement port orifices which allow cement to flow into the drilled hole. When a subsequent drilling operation starts, the CFA APV automatically resets to the closed position by way of force when the operator sets the pilot tip and tool on the ground.

In alternate embodiments of the Automatic Pilot Valve System for Foundation Tooling the APV housing of the present invention is configured to accept and secure any number of various drill head shafts and can be constructed by being machined or forged resulting in a one-piece APV housing, or manufactured by welding the commonly available steel components into the desired size and configuration, resulting in a manufactured multi-piece APV housing.

The Automatic Pilot Valve System for Foundation Tooling primary features will include as prominent design and operational features: (1) the APV of the present invention can be constructed of a one-piece machined, forged or cast exterior frame valve housing or a multi-piece welded or machined constructed interior frame valve housing; (2) the APV of the present invention can be securely affixed to or mounted within a foundation tool externally or installed internally; (3) the APV of the present invention includes one or more valve port openings and one or more pilot assembly retainer bolts; (4) the APV of the present invention automatically shifts from a closed position while drilling to an open position while lifting to allow cement to flow into the drilled hole; (5) the APV of the present invention includes one or more pilot locking bolt holes and one or more pilot knock out holes; (6) the APV of the present invention includes a pilot assembly with a pilot shaft structured to block the flow of cement when drilling operations are underway, and to allow the cement to flow out of the APV system when being lifted out of the drilled hole; (7) the APV of the present invention can be used with foundation tools, displacement tools and other applicable tools.

The Automatic Pilot Valve System for Foundation Tooling of the present invention comprises: (a) a pilot valve housing structured to be secured to an auger stem having a cement supply pipe located within said auger stem, wherein said pilot valve housing defines an interior channel configured for accepting a pilot shaft and wherein said pilot valve housing includes one or more openings therein; (b) a pilot shaft having an upper pilot shaft section and a lower pilot shaft section configured to be moveably inserted into said pilot valve housing; (c) a one or more retaining bolts located in said upper pilot shaft section and securely affixed to said upper pilot shaft section wherein said one or more retaining bolts are structured to extend into said one or more openings located in said pilot valve housing and thereby limit the travel of said pilot shaft within said pilot valve housing; and (d) a pilot tip having one or more cutter bits affixed thereto, located in said lower pilot shaft section; wherein when the automatic pilot valve system for foundation tooling is drilling down into an earth soil hole the upper pilot shaft section is pressed up against the auger system and closes off the cement supply pipe and covers said one or more openings in said pilot valve housing to prevent the flow of cement into the drilled hole, and further wherein when said automatic pilot valve system for foundation tooling is being lifted out of the drilled earth soil hole the pilot shaft extends downwardly to open up the cement supply pipe and allows the cement to flow out of the one or more openings in said pilot valve housing, thereby automatically filling the drilled hole with cement.

With respect to the above description then, it is to be realized that the optimum dimensional relationships for the parts of the Automatic Pilot Valve System for Foundation Tooling, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Automatic Pilot Valve System for Foundation Tooling. Further, since numerous modifications and changes will readily occur to those skilled in the art, it is not desired to limit the Automatic Pilot Valve System for Foundation Tooling to the exact construction and operation shown and described, and accordingly, all suitable modifications and equivalents may be resorted to falling within the scope of this application.

BRIEF DESCRIPTION OF THE DRAWINGS

The accompanying drawings, which are incorporated in and form a part of this specification, illustrate embodiments of the Automatic Pilot Valve (APV) System for Foundation Tooling and together with the description, serve to explain the principles of this application.

DETAILED DESCRIPTION OF THE PREFERRED EMBODIMENTS

As required, the detailed embodiments of the present Automatic Pilot Valve System for Foundation Tooling 30, 40, 60, 80, 100, 130, 240 and 340 are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure as well as combination.

Figure 1:
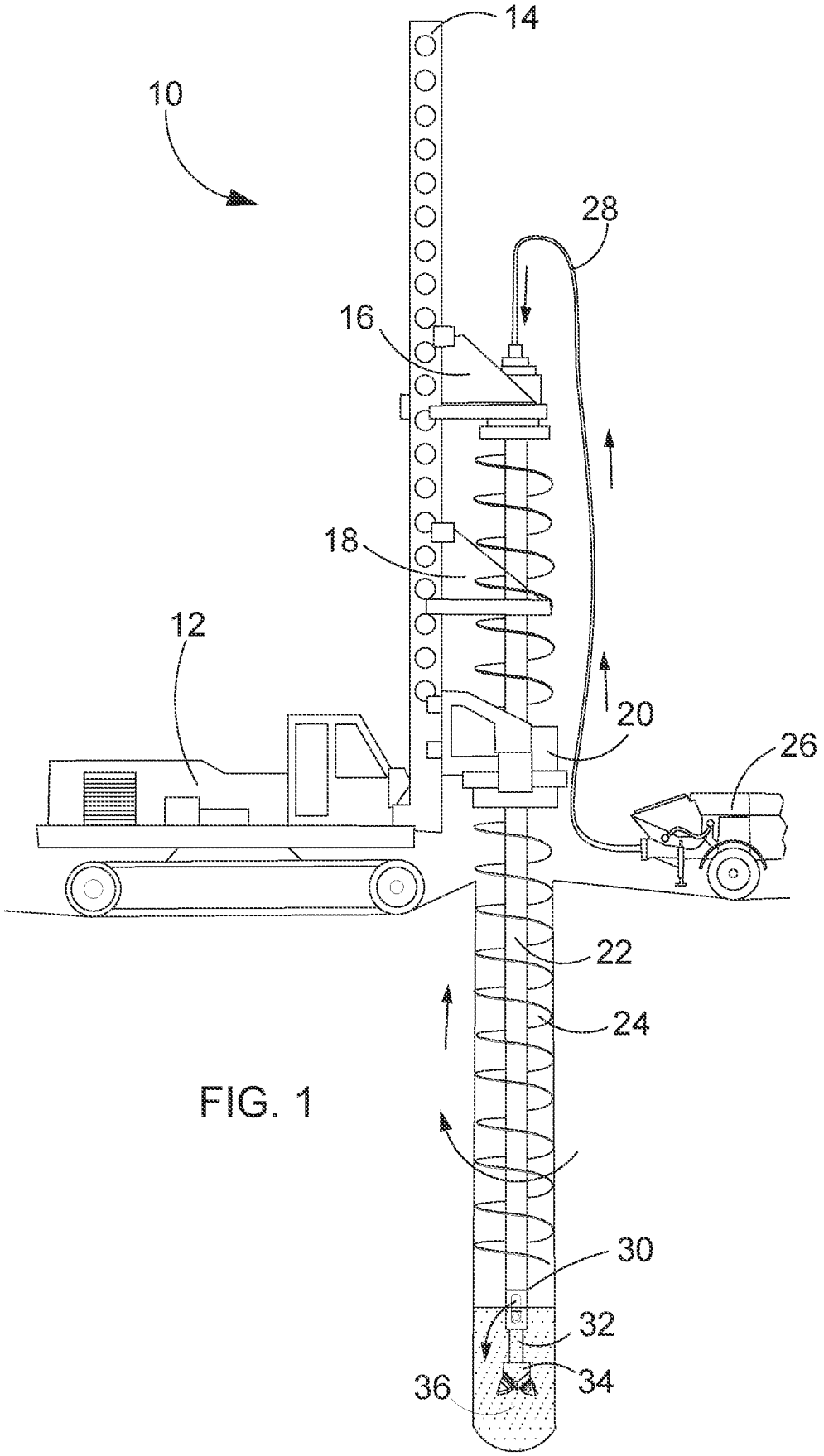
FIG. 1 depicts a typical auger pile rig set up on site for the purpose of drilling an earth piling, including a continuous flight auger mounted on a drill rig in combination with a cement pump and a cement supply hose.

FIG. 1 depicts a typical auger pile rig set up on site for the purpose of drilling an earth piling, including a continuous flight auger (CFA) mounted on a drill rig in combination with a cement pump and a cement supply hose. Referring now to FIG. 1 there is illustrated a continuous flight auger pile drilling rig 10 set up, including a drill rig cab 12, a drill rig mast 14, an auger rotary drive 16, an auger brace 18, an auger centralizer 20, all supporting an auger stem 22 having auger flighting blades or flightings 24 thereon. The CFA drill rig 10 works by rotation of the auger stem 22 and auger flights 24 (see direction arrow) to drill the hole. Then when the desired depth is reached, the CFA and affixed automatic pilot valve system 30 is lifted out of the hole (see direction arrow) while simultaneously depositing cement 36 into the drilled hole. Cement is supplied using a cement pump 26 and a cement supply hose 28 which moves cement (see direction arrows) into a centrally located cement supply pipe within the auger stem 22, not seen. Affixed to the lower end of the auger stem is an automatic pilot valve (APV) system for foundation tooling 30 constructed in accordance with the present invention. This APV system 30 includes a valve housing having an opening therein to allow the flow of cement into the drilled hole, see direction arrow. This flow of cement occurs when the APV system 30 is being lifted out of the drilled hole. When the pilot tip 34 is lifted, the pilot shaft 32 is extended downwardly creating an opening in the valve housing, and it is this opening that the cement flows out of, thereby subsequently filling the hole with flowing cement (see direction arrow). This automatic pilot valve system 30 operation is described in greater detail below.

Figure 2:
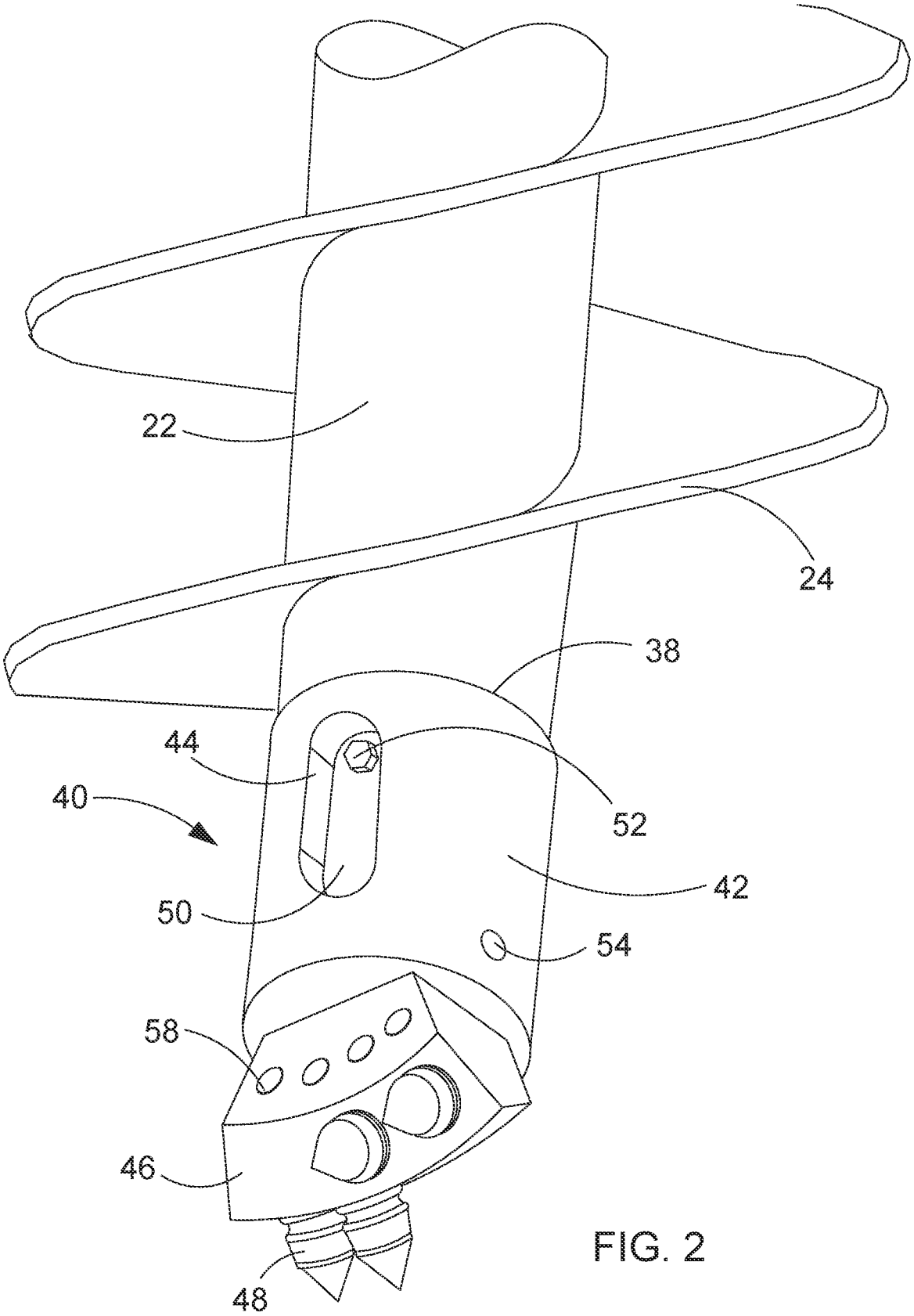
FIG. 2 depicts an APV system valve housing assembly in the drilling closed pilot valve position mounted on the distal end of a CFA.

FIG. 2 depicts an APV system valve housing/pilot shaft assembly 40 in the drilling or closed pilot valve position mounted on the distal end of a CFA. Here is shown a one-piece machined, forged or cast exterior frame APV system 40 valve housing 42 affixed to an auger stem 22 having auger flights 24 by a welded connection 38. The valve housing 42 includes one or more openings 44. Located below the housing 42 is a pilot tip 46 having multiple cutter bits 48 attached thereto. This pilot tip 46 is attached to the lower section of the pilot shaft (not shown). The upper section of the pilot shaft 50 has a retaining bolt 52 attached. This retaining bolt 52 limits the upward and downward travel of the pilot shaft 50 within the valve housing 42 to the dimensions of the opening 44 in the valve housing 42. The valve housing 44 also includes a pilot locking bolt hole 54 for the purpose of freezing movement of the pilot shaft 50 within the valve housing 42. The pilot tip also has a plurality of cutter bits 48 and corresponding cutter bit removal punch holes 58. As is illustrated here, when the APV system 40 is used in drilling operations, pressure on the pilot tip 46 prevents the pilot shaft 50 from dropping and allowing the opening 44 to open up and let cement flow out of the auger stem cement supply pipe (not shown).

Figure 3:
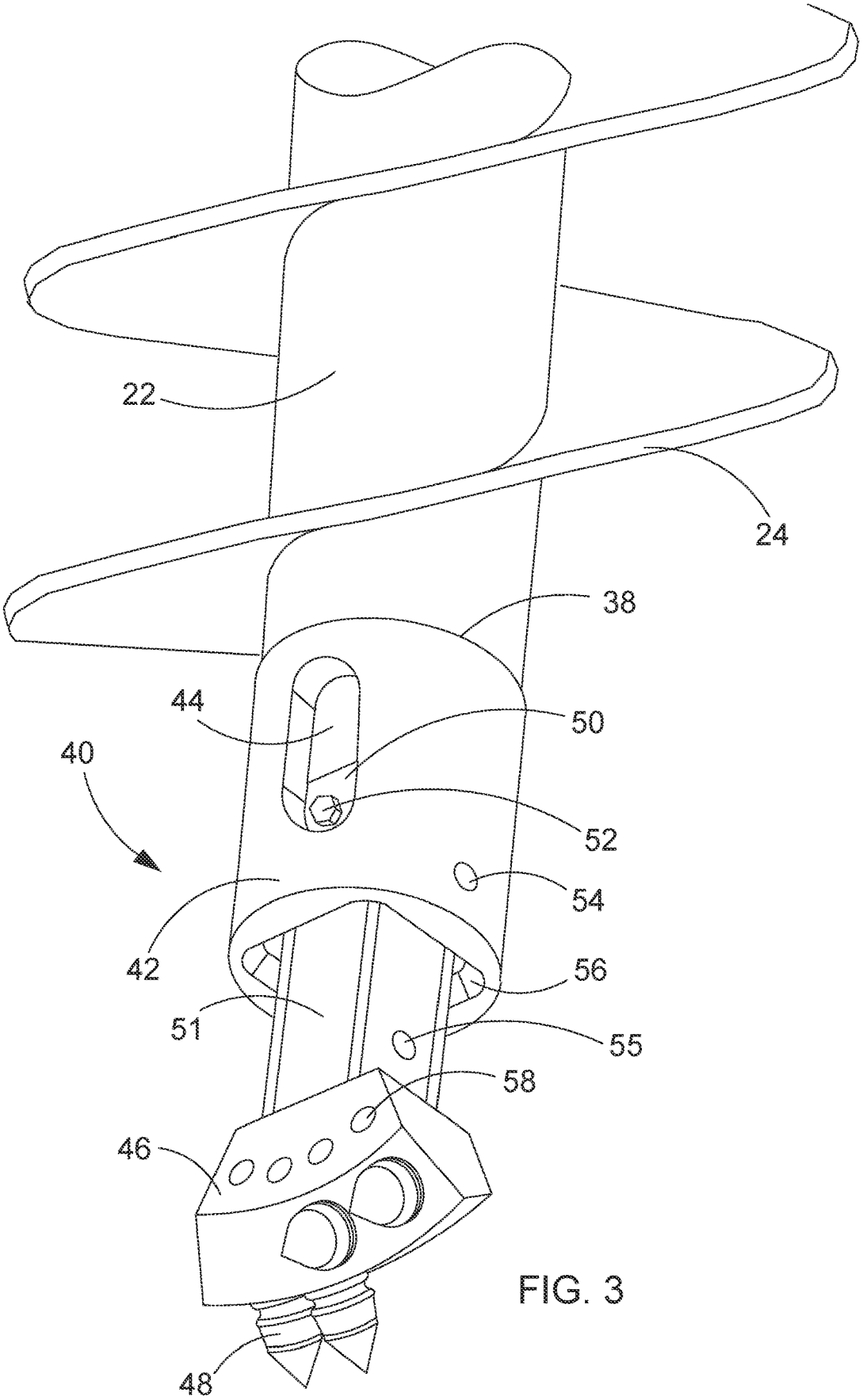
FIG. 3 depicts an APV system valve housing assembly in the lifting open pilot valve position mounted on the distal end of a CFA.

FIG. 3 depicts an APV system valve housing/pilot shaft assembly in the lifting or open pilot valve position mounted on the distal end of a CFA. Again, as in FIG. 2, here is shown a one-piece machined, forged or cast exterior frame APV system 40 valve housing 42 affixed to an auger stem 22 by a welded connection 38. The valve housing 42 includes one or more openings 44. Located below the housing 42 is a pilot tip 46 having multiple cutter bits 48 attached thereto. This pilot tip 46 is attached to the lower section of the pilot shaft 51. The upper section of the pilot shaft 50 has a retaining bolt 52 attached. This retaining bolt 52 limits the upward and downward travel of the pilot shaft 50 and 51 within the valve housing 42 to the dimensions of the opening 44 in the valve housing 42. The valve housing 44 also includes a pilot locking bolt hole for the purpose of freezing movement of the pilot shaft 50 within the valve housing 42. The pilot tip also has a plurality of cutter bits 48 and cutter bit removal punch holes 58. When the APV system 40 is finished with downward drilling operations, the auger stem is lifted out of the hole releasing pressure on the pilot tip 46 and allowing the upper pilot shaft 50 to slide down and extend out of the square-shaped pilot shaft accepting opening 56 which exposes the lower pilot shaft 51. This movement in the pilot shaft 50 and 51 allows the valve port opening 44 to open up and let cement flow out of the auger stem cement supply pipe (not shown) which is in fluid communication with the valve port opening 44. Also seen in this FIG. 3, is the pilot locking bolt hole 55 which is adjacent to the pilot locking bolt hole 54 in FIG. 2. These pilot locking bolt holes 54 and 55 are used to freeze the movement in the pilot shaft 50 and 51 by extending a locking bolt (not shown) through the housing pilot locking bolt hole 54 and into the pilot shaft locking bolt hole 55.

Figure 4:
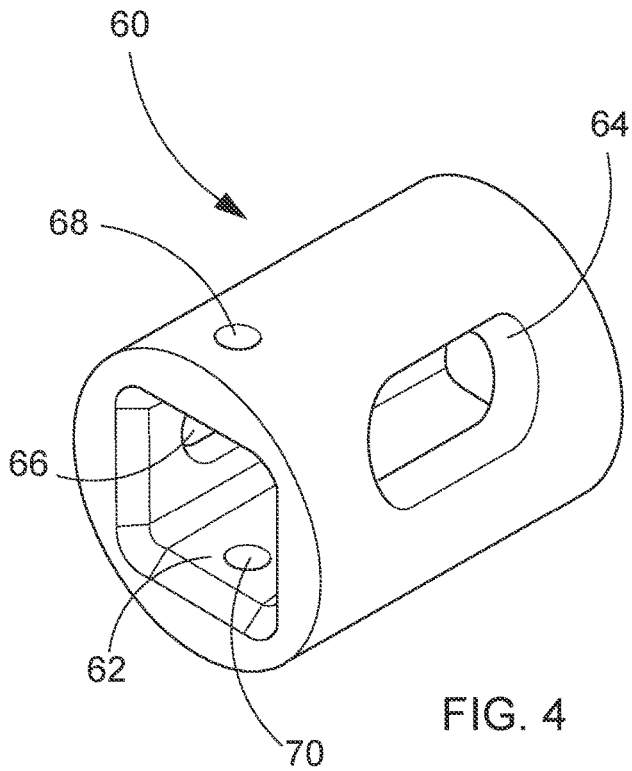
FIG. 4 depicts a bottom and side perspective view of a disassembled one-piece machined, forged or cast frame valve housing illustrating the various orifices therein. Can be fixed to the outside of the foundation tool stem or fixed to the inside of the foundation tool stem.

FIG. 4 depicts a bottom and side perspective view of a disassembled one-piece machined, forged or cast frame valve housing 60 illustrating the various orifices configured therein. This view of the valve housing 60 shows the square-shaped valve shaft accepting opening 62 in the bottom of the housing and two valve port openings 64 and 66 in each side of the valve housing 60. There is also seen a port locking bolt hole 68 in one side of the valve housing 60 as well as another port locking bolt hole 70 in the opposite side of the valve housing 60. It should be understood that this valve housing 60 can be externally affixed to the outside of the foundation tool stem by welding, or internally affixed to the inside of the foundation tool stem, again by welding.

Figure 5:
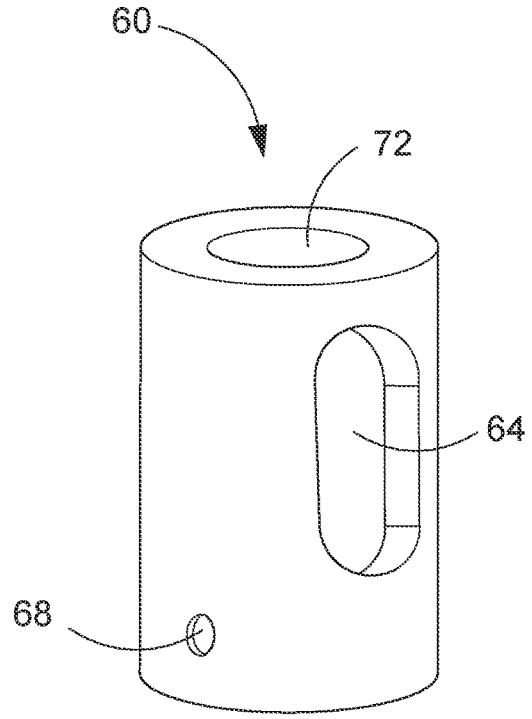
FIG. 5 depicts a top and side perspective view of the disassembled one-piece machined, forged or cast frame valve housing, as shown in FIG. 4.

FIG. 5 depicts a top and side perspective view of the disassembled one-piece machined, forged or cast frame valve housing 60, as shown in FIG. 4. This view illustrates the round-shaped inner cement pipe connection hole 72 located in the top of the valve housing 60. Also seen is the valve port opening 64 and the pilot locking bolt hole 68, also located on one side of the valve housing 60.

Figure 6:
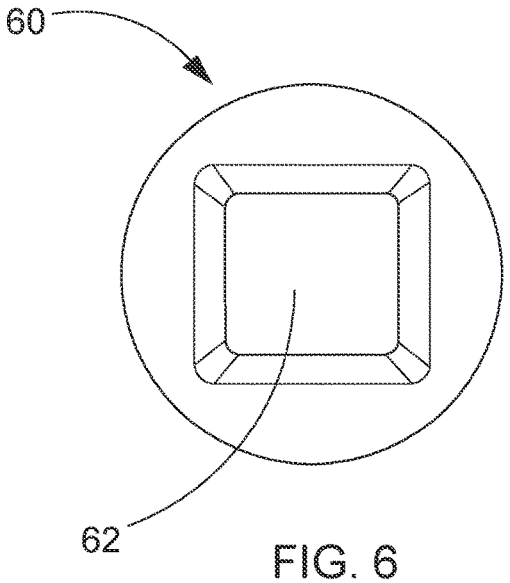
FIG. 6 depicts a bottom view of the disassembled one-piece machined, forged or cast frame valve housing, as shown in FIG. 4, and while the valve housing here is structured to accept a square shaped pilot shaft, as shown in FIGS. 8 through 11, it is anticipated that the pilot shaft and the valve housing could be configured in other shapes, including an octagon or various other shapes.

FIG. 6 depicts a bottom view of the disassembled one-piece machined, forged or cast frame valve housing 60, as shown in FIG. 4, and while the valve housing pilot shaft accepting opening 62 here is structured to accept a square-shaped pilot shaft, as shown in FIGS. 8-11, it is anticipated that the pilot shaft (see 81 and 82 below) and the valve housing pilot shaft accepting opening 62 could be configured in numerous other shapes, including a pentagon shape, a hexagon shape, an octagon shape or various other multi-sided shapes.

Figure 7:
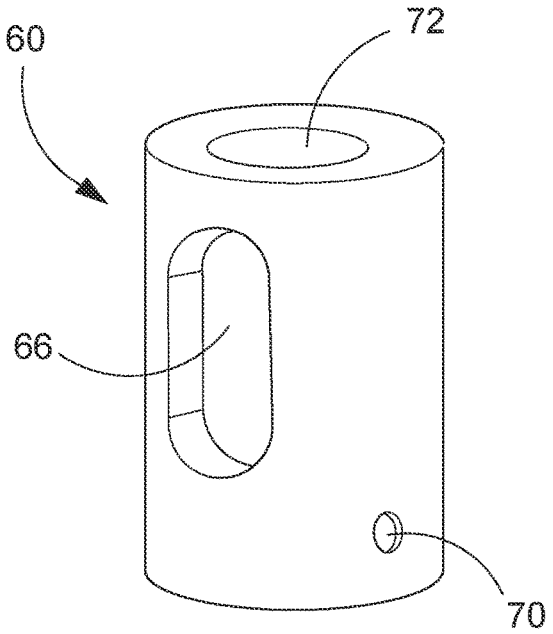
FIG. 7 depicts a top and side perspective view of the disassembled one-piece machined, forged or cast frame valve housing, as shown in FIG. 4, here showing the opposite side of FIG. 5.

FIG. 7 depicts a top and side perspective view of the disassembled one-piece machined, forged or cast frame valve housing 60, as shown in FIG. 4, here showing the opposite side of FIG. 5. This view illustrates the round-shaped inner cement pipe connection hole 72 located in the top of the valve housing 60. Also seen is the valve port opening 66 and the pilot locking bolt hole 70, also located on one side (here the opposite side of that shown in FIG. 5) of the valve housing 60.

Figure 8:
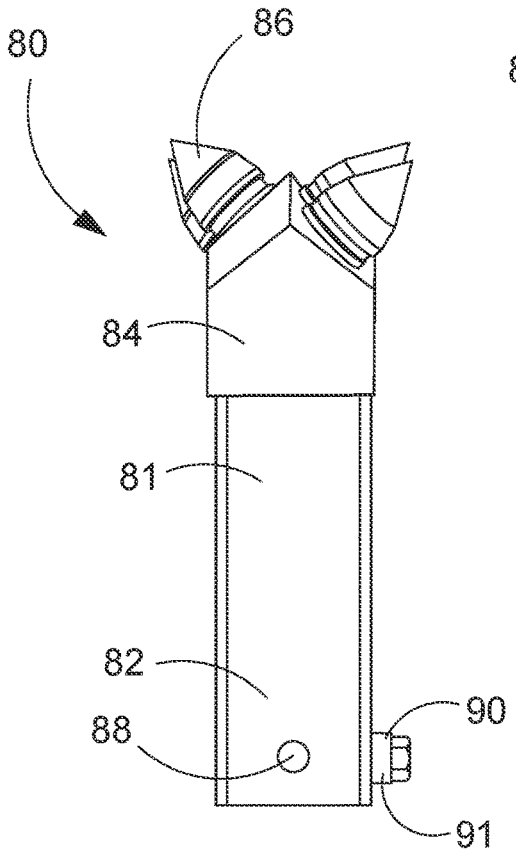
FIG. 8 depicts a side elevational view of a pilot assembly structured to be inserted into the APV valve housing frame.

FIG. 8 depicts a side elevational view of a pilot assembly 80 specifically structured to be inserted into and used in connection with the APV valve housing, as previously described in FIGS. 4-7. The pilot assembly comprises a pilot shaft upper section 81 and a pilot shaft lower section 82. Affixed to the pilot shaft lower section is a pilot tip 84 having a plurality of cutter bits 86. Located on the lower pilot shaft section is a pilot retainer bolt or pin hole 88 and a retainer bolt 90. The retainer bolt shown here in FIG. 8 also includes a spacer washer 91 to extend the working length of the retainer bolt, which limits the pilot shaft travel within the valve housing. The pilot retainer bolt hole or pin hole 88 enables the pilot shaft to be inserted into the valve housing at a 90 degree angle different to the configuration as shown in these FIGS. 8-11, as desired.

Figure 9:
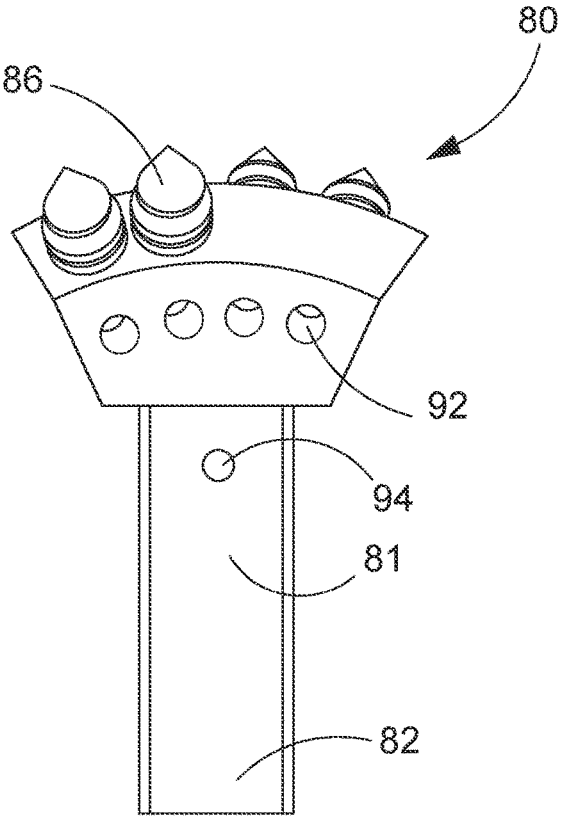
FIG. 9 depicts a rear elevational view of a pilot assembly structured to be inserted into the APV valve housing frame.

FIG. 9 depicts a rear elevational view of a pilot assembly 80 specifically structured to be inserted into the APV valve housing, as previously described in FIGS. 4-7. The pilot assembly comprises a pilot shaft upper section 81 and a pilot shaft lower section 82. Located in the pilot shaft lower section 81 is a pilot locking bolt hole 94 which is used to freeze movement in the pilot shaft when desired. Also seen in this view are the cutter bit removal punch holes 92 located within the pilot tip. These cutter bit removal punch holes 92 facilitate the removal and replacement of the cutter bits 86.

Figure 10:
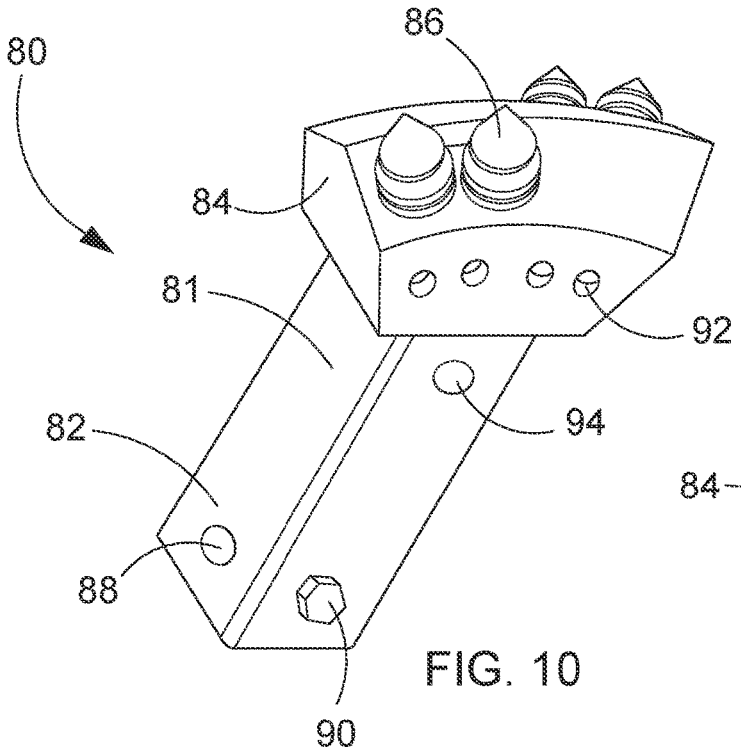
FIG. 10 depicts a front, side and bottom perspective view of a pilot assembly structured to be inserted into the APV valve housing frame.

FIG. 10 depicts a front, side and bottom perspective view of a pilot assembly 80 specifically structured to be inserted into the APV valve housing, as previously described in FIGS. 4-7. Affixed to the lower pilot shaft section 81 is the pilot tip 84 including a plurality of cutter bits 86 and cutter bit removal punch holes 92. Also located in the lower pilot shaft section 81 is a pilot locking bolt hole 94 which is used to freeze movement in the pilot shaft when desired. Also seen in this view is a retainer bolt 90 (with no spacer) and a pilot retainer bolt hole or pin hole 88 located in the upper pilot shaft section 82.

Figure 11:
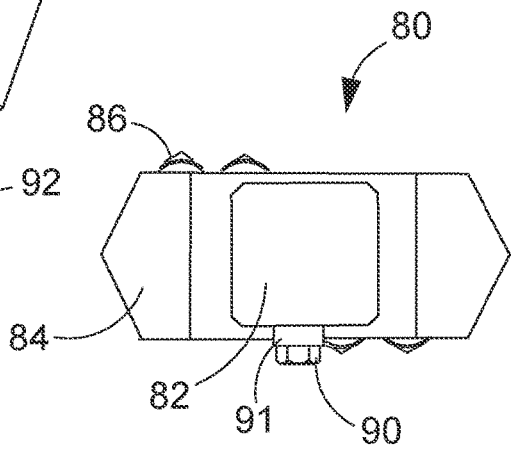
FIG. 11 depicts a top plan view of a pilot assembly structured to be inserted into the APV valve housing frame and while the pilot shaft here is structured to be a square shaped pilot shaft, it is anticipated that the pilot shaft and the valve housing, as shown in FIGS. 4 and 6, could be configured in other shapes, including an octagon or various other shapes.

FIG. 11 depicts a top plan view of a pilot assembly 80 specifically structured to be inserted into the APV valve housing and while the pilot shaft 82 here is structured to be a square-shaped pilot shaft, however, it is anticipated that the pilot shaft and the valve housing, as shown in FIGS. 4 and 6, could be configured in other shapes, including a pentagon, a hexagon, an octagon or numerous various other multi-sided shapes, as desired. Additionally, the retainer bolt 90 is shown here having a spacer washer 91 which acts to extend the working length of the retainer bolt 90. It should be understood that the retainer bolt can be used with and without a spacer washer 91 as required for the particular drilling operation to be performed.

Figure 12:
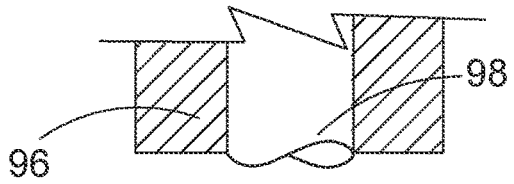
FIG. 12 depicts a cross-sectional view of the CFA distal end, illustrating the centrally located cement supply pipe therein, and structured to accept the one-piece machined, forged or cast frame valve housing.

FIG. 12 depicts a cross-sectional view of the CFA auger stem distal end 96, illustrating the centrally located cement supply pipe 98 therein, and structured to accept the one-piece machined, forged or cast frame valve housing 40 (sec FIG. 14 below) wherein the auger stem distal end can be welded to the upper portion of the valve housing 40.

Figure 13:
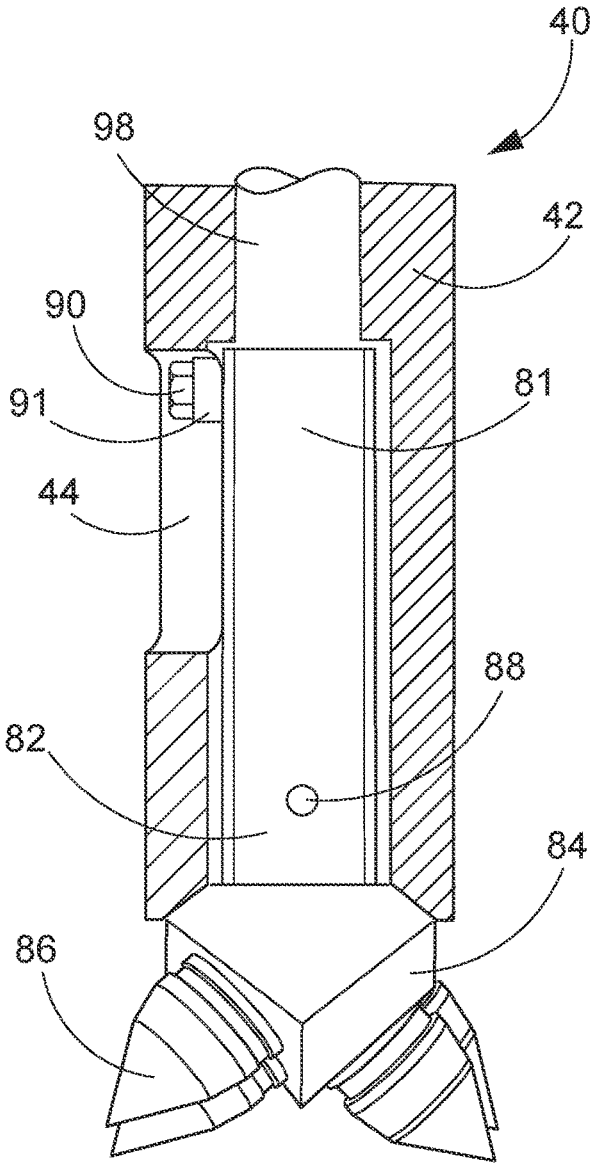
FIG. 13 depicts a side elevational, cross-sectional view of the assembled APV system for foundation tooling, illustrating the pilot assembly inserted into the one-piece machined, forged or cast frame valve housing.

FIG. 13 depicts a side elevational, cross-sectional view of the assembled APV system 40 for foundation tooling valve housing 42, illustrating the pilot assembly comprising a pilot shaft upper section 81 and a pilot shaft lower section 82, fully inserted into the one-piece machined, forged or cast frame valve housing 42. Valve housing 42 includes one valve port opening 44 on one side. It is anticipated that one or more of these valve port openings 44 can be configured into the valve housing 42 (see FIG. 20 below). The pilot assembly includes a pilot tip 84 having a plurality of cutter bits 86 attached thereto. In this particular view, the pilot shaft 81 and 82 is fully inserted into the valve housing 42 and thereby pushed up against the cement supply pipe 98 such that during drilling operations the pilot assembly upper pilot shaft 81 blocks cement from flowing out of the cement supply pipe 98 and out of valve port opening 44. In this side cross-sectional view of FIG. 13, the retaining bolt 90 and retaining bolt washer 91 extend out into the valve port opening 44, and limit the travel of pilot shaft 81 and 82 within the valve port opening 44. Also seen in this view is the pilot retainer bolt hole or pin hole 88 which when the pilot shaft and the valve housing are pinned together, the pilot retainer bolt hole or pin hole 88 can be used to keep the pilot shaft assembly locked into the valve housing 42 preventing the pilot shaft 81 and 82 from moving downwardly, when a fully closed valve port opening 44 is desired.

Figure 14:
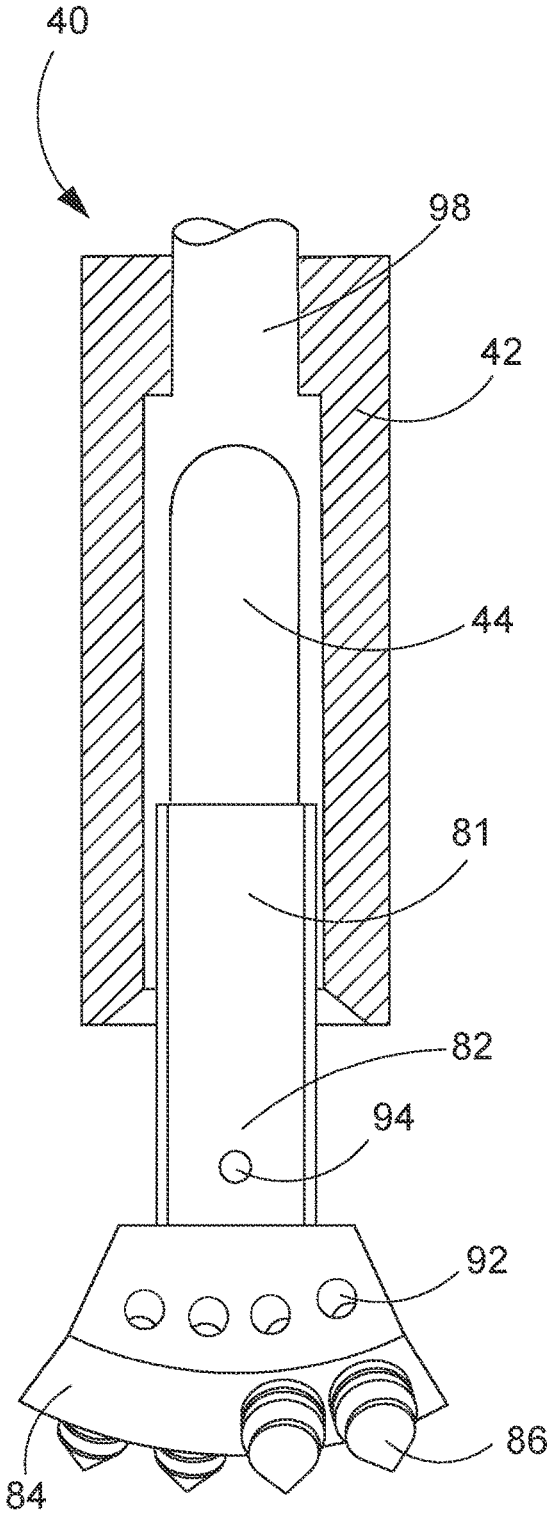
FIG. 14 depicts a rear elevational, cross-sectional view of the assembled APV system for foundation tooling, illustrating the pilot assembly inserted into the one-piece machined, forged or cast frame valve housing.

FIG. 14 depicts a rear elevational, cross-sectional view of the assembled APV system for foundation tooling 40, illustrating the pilot assembly comprising a pilot shaft upper section 81 and a pilot shaft lower section 82, fully extended out of the one-piece machined, forged or cast frame valve housing 42. Again as in FIG. 13, valve housing 42 includes one valve port opening 44 on one side. It is anticipated that one or more of these valve port openings 44 can be configured into the valve housing 42 (see FIG. 20 below). The pilot assembly includes a pilot tip 84 having a plurality of cutter bits 86 attached thereto, and this view shows the cutter bit removal punch holes 92. In this particular view, the pilot shaft 81 and 82 is fully extended downwardly and out of the valve housing 42 and thereby removed from being pushed up against the cement supply pipe 98. Following the conclusion of drilling operations the assembled APV system for foundation tooling 40 is lifted out of the drilled hole and the pilot assembly upper pilot shaft 81 moves away from the cement supply pipe 98 and thereby allows cement to flow out of the cement supply pipe 98 and subsequently out of valve port opening 44. In this rear cross-sectional view of FIG. 14, the retaining bolt 90 and retaining bolt washer 91 are not seen. Also seen in this view is the pilot locking bolt hole 94 located within the pilot shaft lower section 82.

Figure 15:
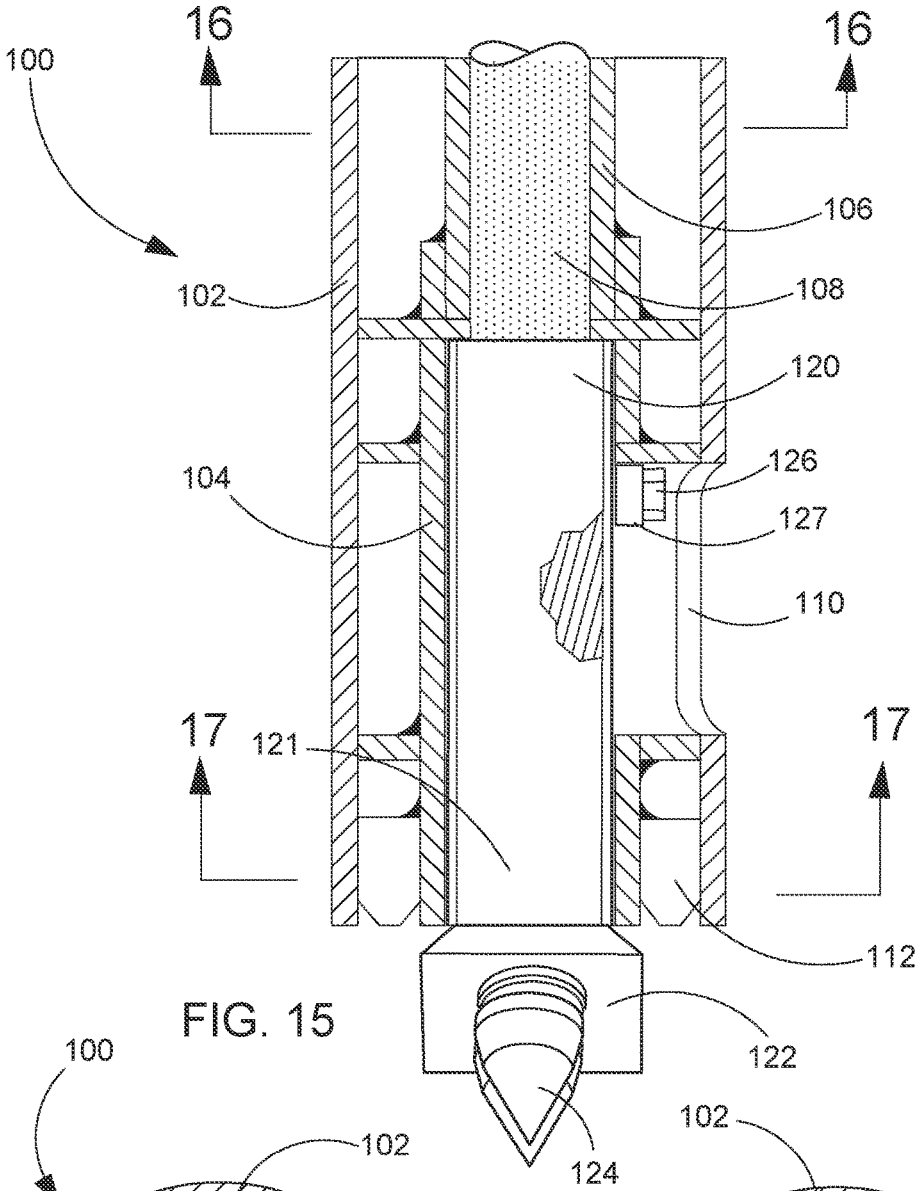
FIG. 15 depicts a side elevational, cross-sectional view of the assembled APV system for foundation tooling, illustrating the pilot assembly inserted into an interior valve housing including a multi-piece welded or machined constructed interior frame valve housing.

FIG. 15 depicts a side elevational, cross-sectional view of the assembled APV system for foundation tooling, illustrating the pilot assembly comprising a pilot shaft upper section 120 and a pilot shaft lower section 121 inserted into an interior installed valve housing comprising a multi-piece welded or one-piece cast, forged or machined constructed interior frame valve housing 100. This interior frame valve housing 100 is structured to be inserted into and thereby affixed, typically by welding, to an auger outer pipe stem 102 located at the end of a CFA foundation drilling tool or displacement tool (not shown). The interior frame valve housing 100 includes a welded square tubing frame which defines a pilot shaft accepting channel 104 in the lower end and a cement supply pipe section 106 in the upper end. A beveled weldable spacer 112 connects the interior installed APV system valve housing 100 to the outer auger stem 102. The pilot assembly includes a pilot shaft upper section 120 and a pilot shaft lower section 121, as previously described. When fully inserted, the pilot shaft upper section 120 blocks the cement supply pipe 106, and thereby prevents cement 108 from flowing out into the pilot shaft accepting channel 104 and subsequently out through the valve port opening 110. Located at the pilot shaft lower section 121 is a pilot tip 122 having a plurality of cutter bits 124. Located at the pilot shaft upper section 120 is a retaining bolt 126 having a retaining bolt washer 127. This retaining bolt 126 and retaining bolt washer 127 act to limit the travel of the pilot assembly shaft 120 and 121 within the pilot shaft accepting channel 104 upwardly during drilling operations, and again downwardly during the time when the APV system is being lifted out of the drilled hole and cement 108 is allowed to flow out of the cement supply pipe 106 and through valve port opening 110 to be deposited into the drilled hole (not shown) as desired (see FIG. 19). This FIG. 15 illustrates a multi-piece welded interior frame valve housing 100, but it is anticipated and understood that the interior frame valve housing 100 could also be constructed from a one-piece cast, forged or machined constructed interior frame valve housing 100.

Figure 16:
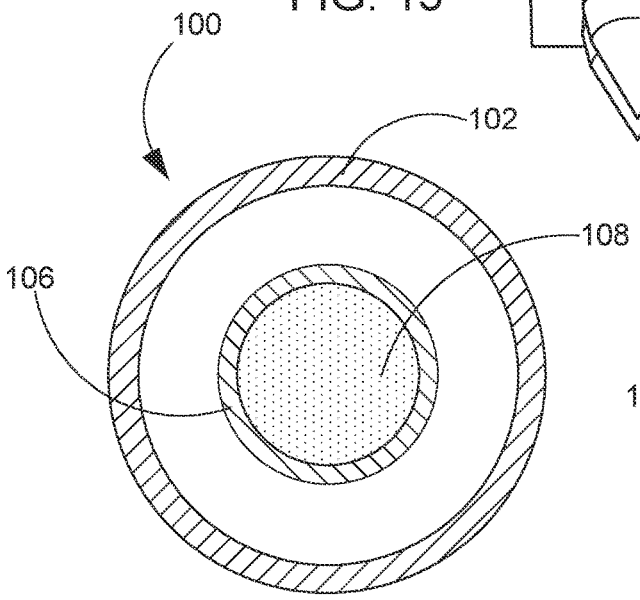
FIG. 16 depicts a cross-sectional view of the upper portion of the assembled APV system for foundation tooling, illustrating the pilot assembly inserted into an interior valve housing including a multi-piece welded or machined constructed interior frame valve housing.

FIG. 16 depicts a cross-sectional view of the upper portion of the assembled APV system for foundation tooling 100, shown in FIG. 15, illustrating the pilot assembly inserted into an interior valve housing including a multi-piece welded or machined constructed interior frame valve housing 104. In this cross-sectional view, the auger outer pipe stem 102 is seen surrounding the cement supply pipe 106 which contains cement 108 therein. This cement supply pipe 106 is in fluid communication with the centrally located cement supply pipe 98 located in the auger stem distal end 96 (see FIG. 12) and is fed cement 108 from a cement hose 28 connected to a cement pump 26 (see FIG. 1). In this way, when the APV system 100 is being lifted, the pilot shaft 120 and 121 lowers and allows cement 108 to flow into the pilot shaft accepting channel 104 and out the valve port opening 110 into the drilled hole.

Figure 17:
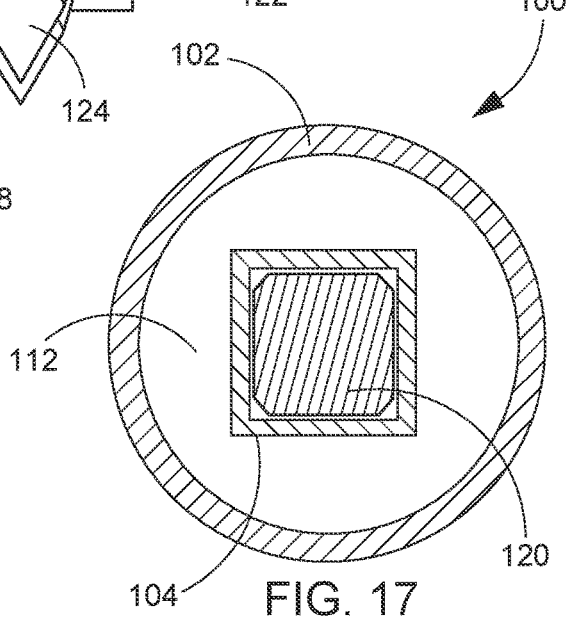
FIG. 17 depicts a cross-sectional view of the lower portion of the assembled APV system for foundation tooling, illustrating the pilot assembly inserted into an interior valve housing including a multi-piece welded or machined constructed interior frame valve housing.

FIG. 17 depicts a cross-sectional view of the lower portion of the assembled APV system for foundation tooling 100, shown in FIG. 15, illustrating the pilot assembly inserted into an interior valve housing including a multi-piece welded or machined constructed interior frame valve housing. This view illustrates the relative position of the outer auger stem 102, the beveled weldable spacer 112, the pilot shaft accepting channel 104, and the lower pilot shaft section 121. When drilling operations are underway, pressure on the pilot shaft 120 and 121 causes the pilot shaft upper section 120 to block the flow of cement 108 out of the cement supply pipe 106 (sec FIG. 15).

Figure 18:
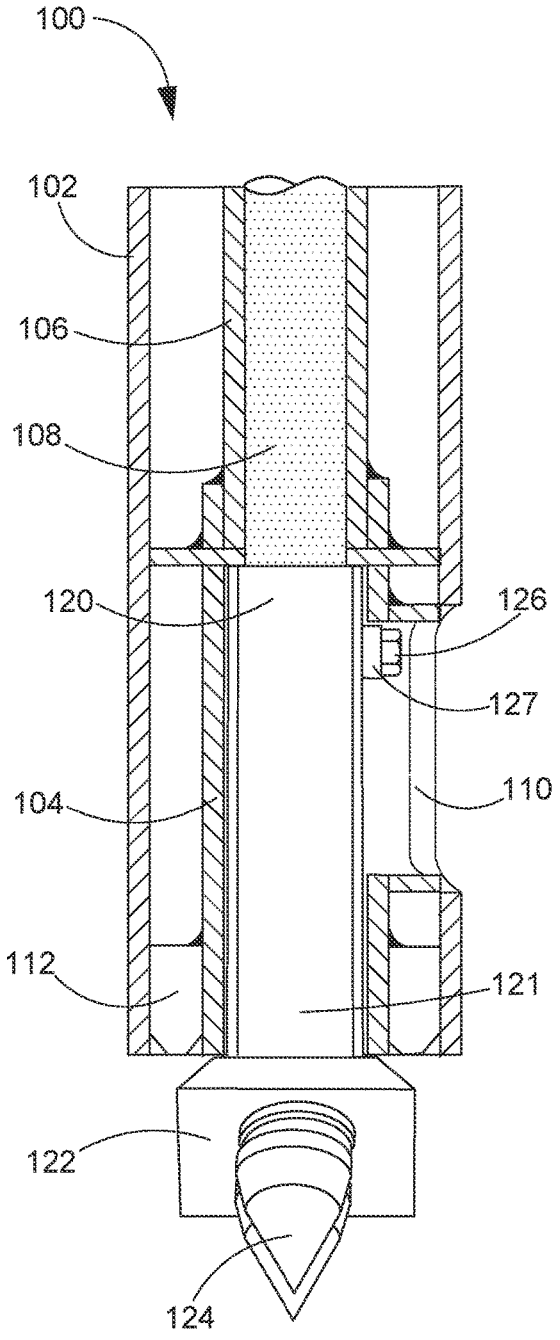
FIG. 18 depicts a side elevational, cross-sectional view of the assembled APV system for foundation tooling, illustrating the pilot assembly inserted into an interior valve housing, illustrated in the closed position to prevent cement within the cement supply pipe to flow out.

FIG. 18 depicts a side elevational, cross-sectional view of the assembled APV system for foundation tooling 100, illustrating the pilot assembly comprising a pilot shaft upper section 120 and a pilot shaft lower section 121 inserted into an interior installed valve housing comprising a multi-piece welded or one-piece cast, forged or machined constructed interior frame valve housing 100, here shown in the closed position to prevent cement 108 within the cement supply pipe 106 to flow out through the valve port opening 110. This is the position of the various parts of the APV system 100 when drilling operations are underway.

Figure 19:
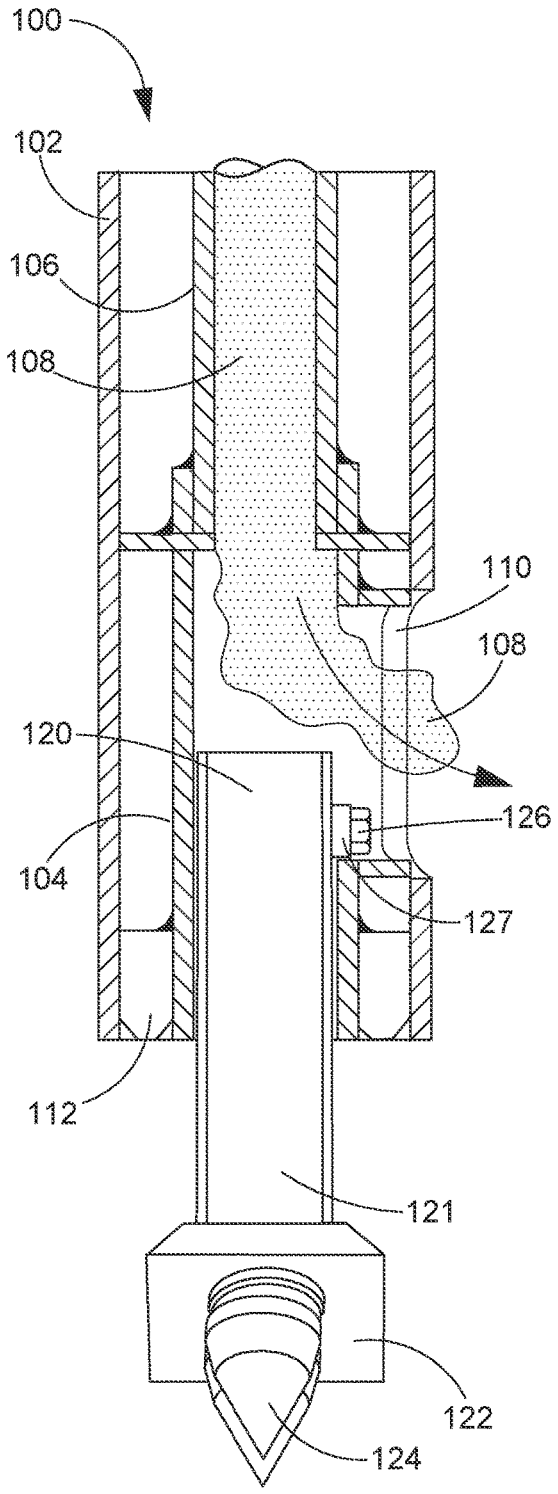
FIG. 19 depicts a side elevational, cross-sectional view of the assembled APV system for foundation tooling, illustrating the pilot assembly inserted into an interior valve housing, illustrated in the open position to allow cement within the cement supply pipe to flow out.

FIG. 19 depicts a side elevational, cross-sectional view of the assembled APV system for foundation tooling 100, illustrating the pilot assembly comprising a pilot shaft upper section 120 and a pilot shaft lower section 121 inserted into an interior installed valve housing comprising a multi-piece welded or one-piece cast, forged or machined constructed interior frame valve housing 100, here shown in the open position to allow cement 108 within the cement supply pipe 106 to flow out through the valve port opening 110. This is the position of the various parts of the APV system 100 when drilling operations are completed and the APV system 100 is being lifted out of the drilled hole.

Figure 20:
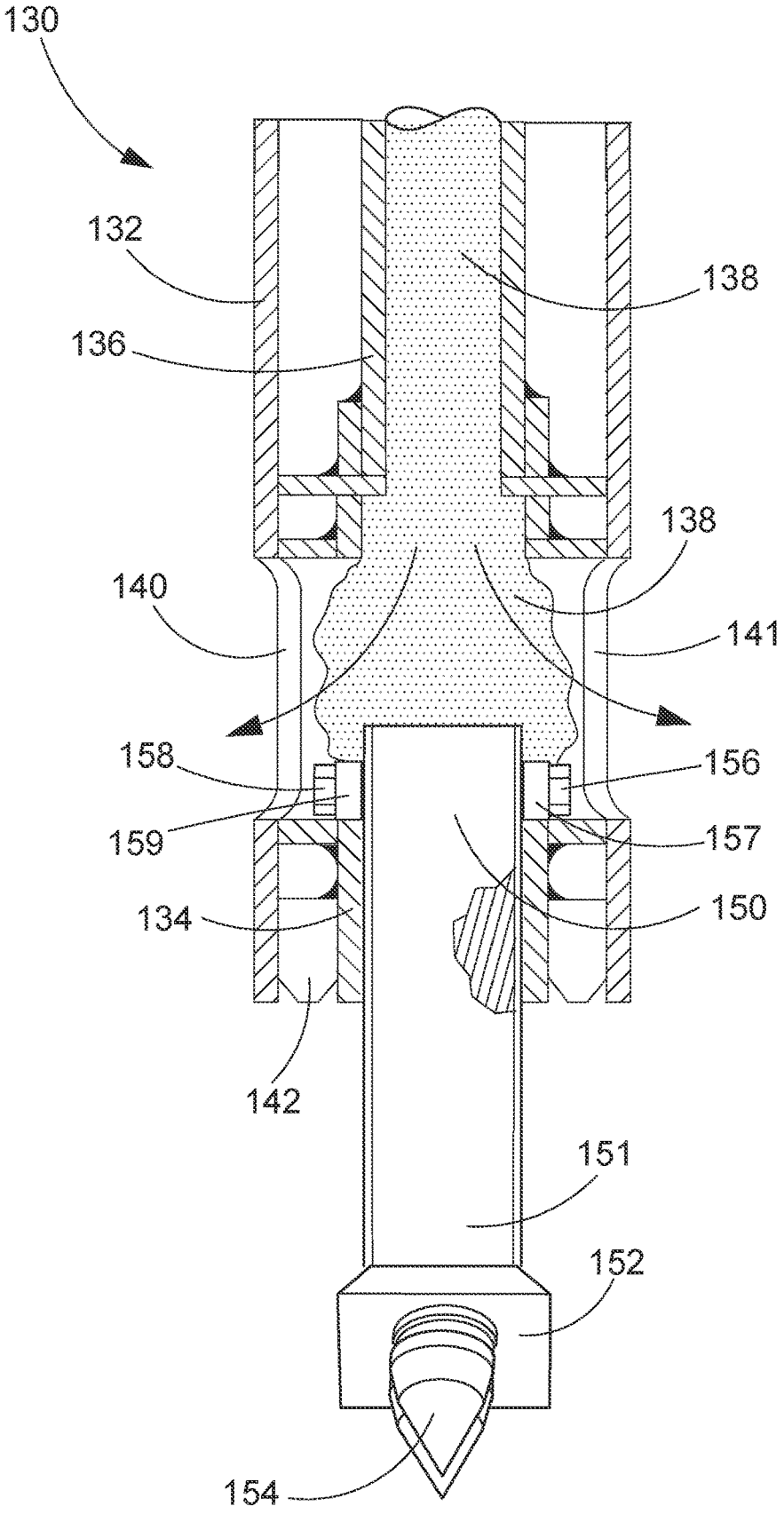
FIG. 20 depicts a side elevational, cross-sectional view of the assembled APV system for foundation tooling, illustrating the pilot assembly inserted into an interior valve housing having two valve port openings, illustrated in the open position to allow cement within the cement supply pipe to flow out.

FIG. 20 depicts a side elevational, cross-sectional view of an alternate embodiment of the assembled APV system for foundation tooling 130, illustrating the pilot assembly inserted into an interior valve housing having two valve port openings 140 and 141, and here shown in the open position to allow cement 138 within the cement supply pipe 136 to flow out of each of the two valve port openings 140 and 141 which are cut out of the outer auger stem 132 after the interior APV system 130 is installed within the outer auger stem 132. The APV system valve housing here is constructed of square tubing welded to define a lower pilot shaft accepting channel 134 and an upper cement supply pipe 136 which contains cement 138. A beveled weldable spacer 142 connects the interior installed APV system valve housing 130 to the outer auger stem 132. The pilot shaft has a pilot shaft upper section 150 and a pilot shaft lower section 151. Located affixed to the pilot shaft lower section 151 is a pilot tip 152 having a plurality of cutter bits 154. Located in the pilot shaft upper section 150 are two retaining bolts 156 and 158, both having retaining bolt washers 157 and 159. In this view, the APV system is being lifted out of the drilled hole, the pilot shaft 150 and 151 lowers and allows cement 138 to flow into the pilot shaft accepting channel 134 and out the two valve port openings 140 and 141 into the drilled hole.

Figure 21:
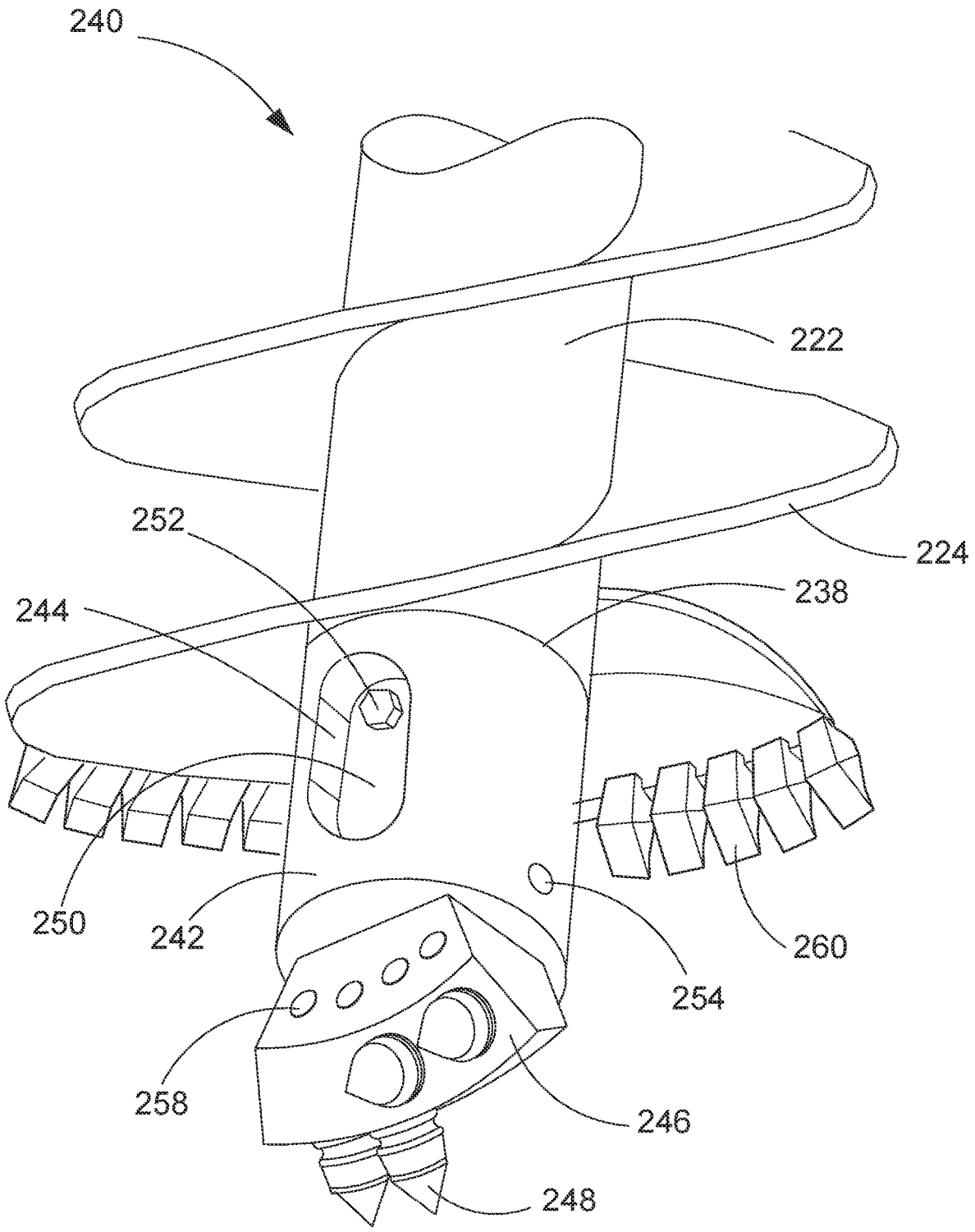
FIG. 21 depicts the CFA mounted APV system valve housing assembly in the drilling closed pilot valve position mounted on the distal end of a CFA, wherein the lower flight of the CFA includes cutting teeth for drilling in difficult ground.

FIG. 21 depicts an alternate embodiment of the CFA externally mounted APV system valve housing assembly 240 in the drilling closed pilot valve position affixed to the distal end of a CFA auger stem 222, wherein the lower flight 224 of the CFA includes a plurality of cutting teeth 260 for drilling in difficult ground. The valve housing 242 is welded to the auger stem 222 by welded connection 238. The valve housing 242 includes a pilot locking bolt hole 254. The pilot shaft upper section 250 is visible through the valve port opening 244 and includes a retaining bolt 252 affixed thereon. The lower pilot shaft (not seen, see FIG. 22) is attached to a pilot tip 246 having a plurality of cutter bits 248, and a plurality of corresponding cutter bit removal punch holes 258 therein. In this view, the APV system 240 is shown in the drilling operations position where the upper pilot shaft 250 blocks cement from flowing out of the valve port opening 244. Again, in this alternate embodiment of an externally affixed APV system 240, the lower flight 224 of the CFA includes a plurality of cutting teeth 260 for drilling in difficult ground.

Figure 22:
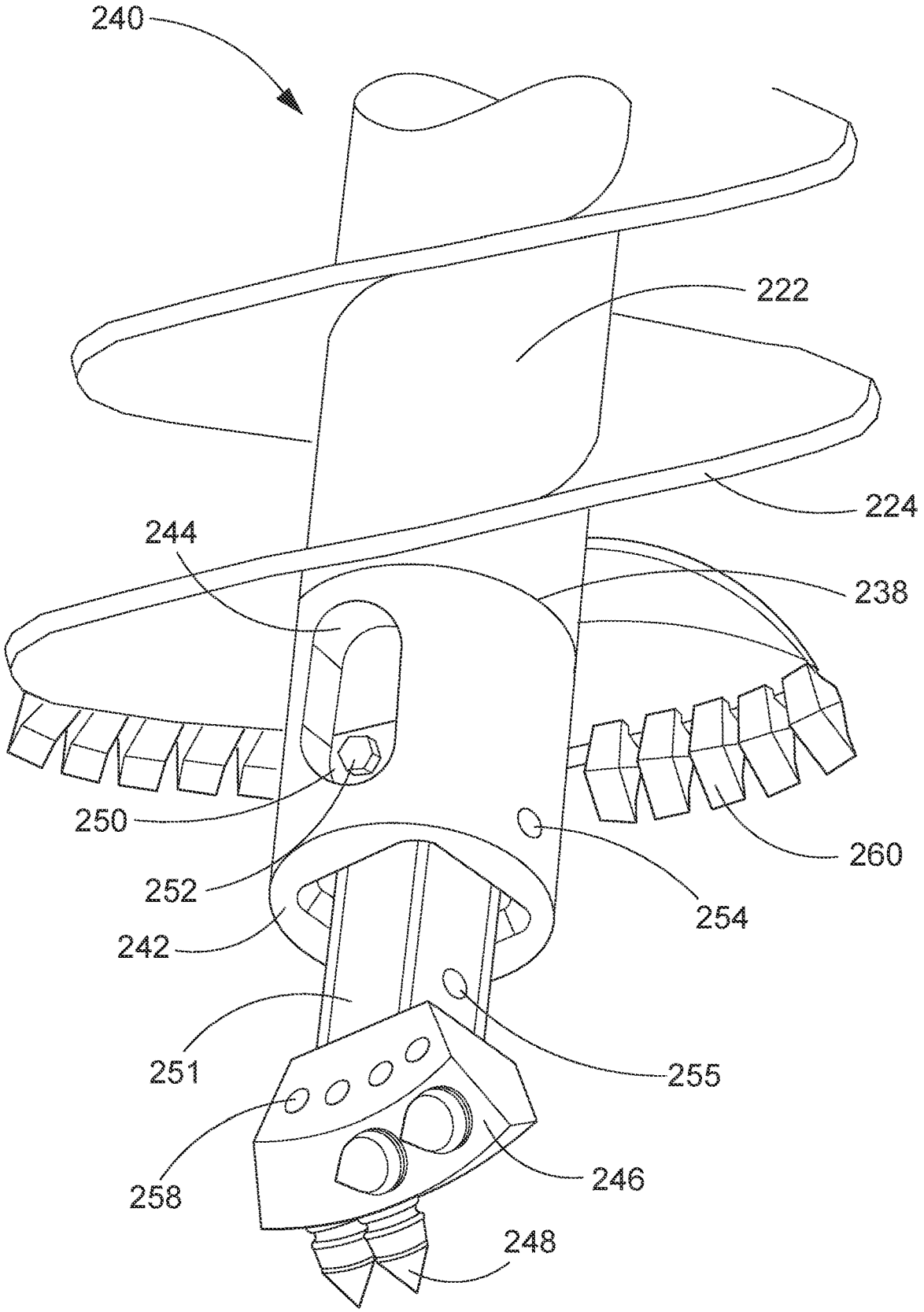
FIG. 22 depicts the CFA mounted APV system valve housing assembly in the lifting open pilot valve position mounted on the distal end of a CFA, wherein the lower flight of the CFA includes cutting teeth for drilling in difficult ground.

FIG. 22 depicts the alternate embodiment of the CFA externally mounted APV system valve housing assembly 240 in the lifting open pilot valve position affixed to the distal end of a CFA auger stem 222, wherein the lower flight 224 of the CFA includes a plurality of cutting teeth 260 for drilling in difficult ground. The valve housing 242 is welded to the auger stem 222 by welded connection 238. The valve housing 242 includes a pilot locking bolt hole 254. The pilot shaft upper section 250 is visible through the valve port opening 244 and includes a retaining bolt 252 affixed thereon. The lower pilot shaft 251 seen fully extended downwardly here and is affixed to a pilot tip 246 having a plurality of cutter bits 248, and a plurality of corresponding cutter bit removal punch holes 258 therein. The travel of the pilot shaft 151 downwardly is limited by the retaining bolt 252. In this view, the APV system 240 is shown in the lifting operations position where the upper pilot shaft 250 has moved out of the way and allows cement to flow out of the valve port opening 244 and into the drilled hole. Again, in this alternate embodiment of an externally affixed APV system 240, the lower flight 224 of the CFA includes a plurality of cutting teeth 260 for drilling in difficult ground.

Figure 23:
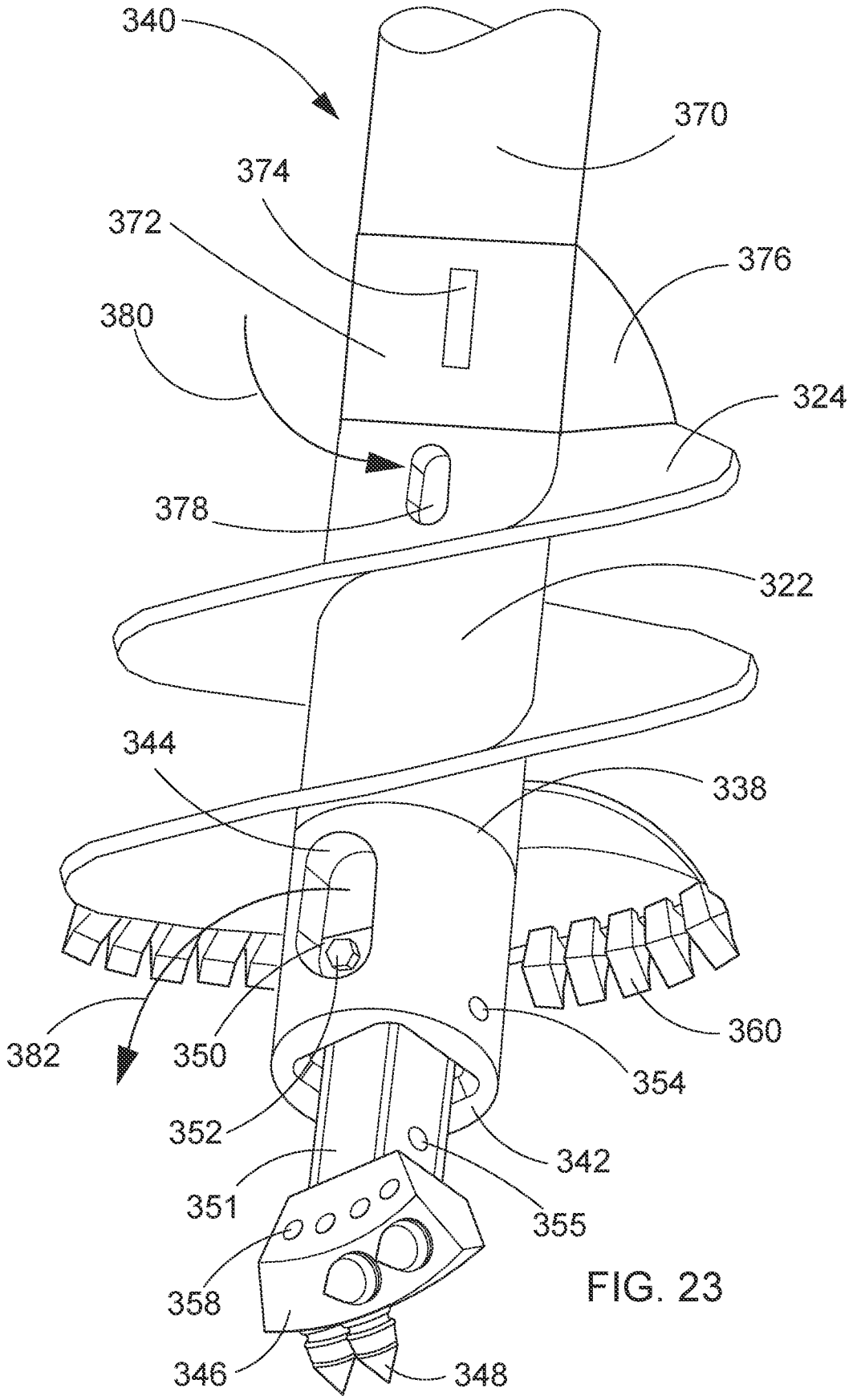
FIG. 23 depicts an alternate embodiment of the APV system including features which facilitate venting ability on regular drilling augers when not passing cement through, enabling the valve to transfer fluid during regular drilling to prevent hydraulic locking, allowing regular augers to pass through fluid filled holes faster without collapsing the holes by preventing suction.

FIG. 23 depicts an alternate embodiment of the APV system 340 including features which facilitate venting ability on regular drilling augers when not passing cement through, enabling the valve to transfer fluid during regular drilling to prevent hydraulic locking, allowing regular augers to pass through fluid filled holes faster without collapsing the holes by preventing suction. Often, when a hole is drilled that hole fills with fluid, typically water. Lifting such an auger is difficult and often hydraulic locking occurs due to excessive suction. This alternate embodiment prevents that from happening by facilitating the flow of fluid through the APV system valve housing when not depositing cement into the drilled hole. The key features and parts of this alternate embodiment APV system 340 include a drive bar 370, a drive connector 372 having a locking slot 374 therein, a gusset 376 bracing the drive connector to the auger flighting 324, and an upper valve port opening 378 cut out of the auger stem 322. APV system valve housing 342 is then welded to the auger stem 322 by the welded connection 338. This APV system valve housing 342 includes a valve port opening 344 and a pilot locking bolt hole 354. In this FIG. 23 view, the APV system 340 is being lifted out of a drilled hole which has filled with water. Because it is being lifted, the upper pilot shaft 350 and the lower pilot shaft 351 are both visible. A retaining bolt 352 is affixed to the upper pilot shaft 350 and limits the travel of the upper pilot shaft 350 in valve port opening 344. Located on the lower pilot shaft 351 is seen the pilot tip 346 having a plurality of cutter bits 348, and a pilot locking bolt hole 355 which corresponds to the pilot locking bolt hole 354 in the valve housing 342. The lower flight 324 of the CFA includes a plurality of cutting teeth 360 for drilling in difficult ground. As this APV system 340 is being lifted, fluid flows into upper valve port opening 378 (see direction arrow 380) cut out of the auger stem 322 and then out of the valve port opening 344 (sec direction arrow 382) preventing hydraulic locking and excessive suction. In this way, significantly less difficulty is encountered when lifting the CFA auger out of a drilled hole filled with water or other fluid.

Figure 24:
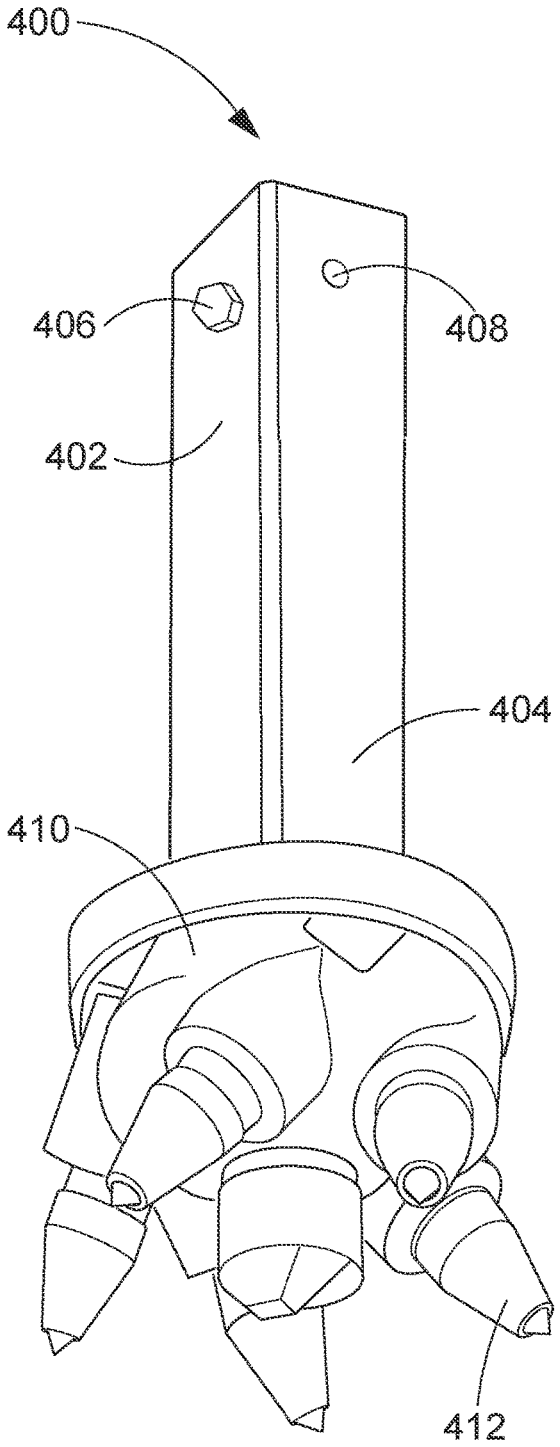
FIG. 24 depicts an alternate pilot point tip head mounted on a pilot shaft structured to be inserted into the APV valve system housing and including a pilot retaining bolt, for use with the APV system for foundation tooling constructed in accordance with the present invention.

FIG. 24 depicts an alternate pilot point tip head drilling tool 400 mounted on an elongated pilot shaft comprising an upper pilot shaft section 402 and a lower pilot shaft section 404 structured to be inserted into, and work in conjunction with, the APV valve system housing (see description above) for foundation tooling constructed in accordance with the present invention. Located on the upper pilot shaft section 402 is a retaining bolt 406 and a retainer bolt or pin hole 408. On the lower pilot shaft section 404 this drilling tool is configured with a drilling head 410 having a plurality of cutter bits 412 removably affixed thereon.

Figure 25:
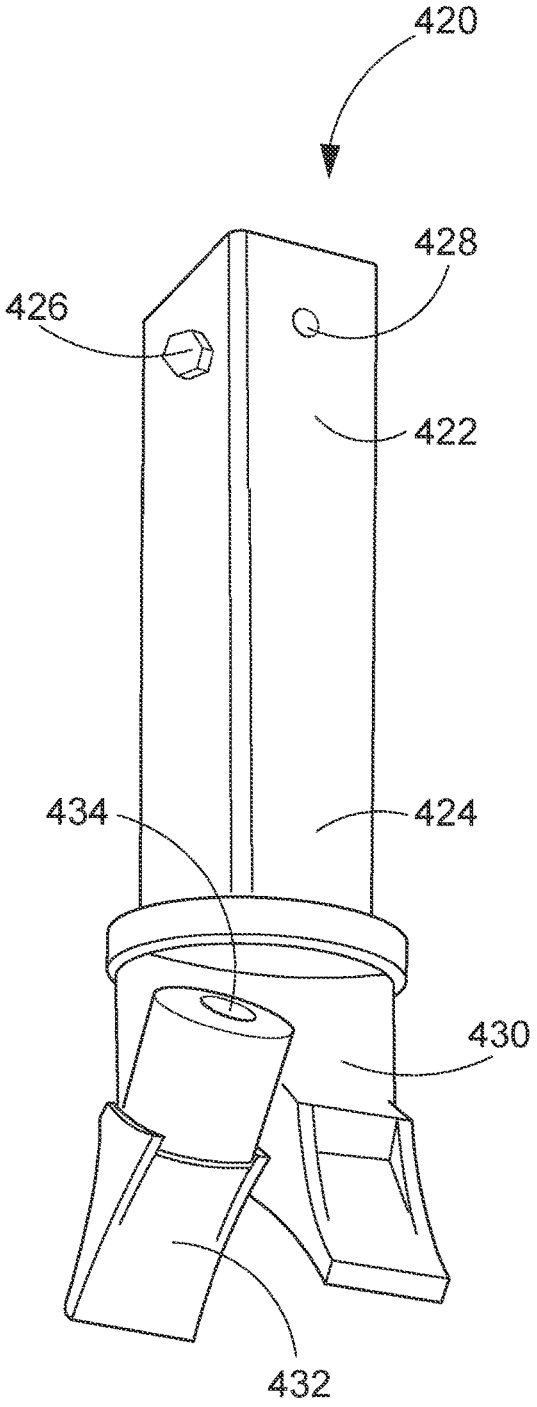
FIG. 25 depicts another alternate pilot point tip head mounted on a pilot shaft structured to be inserted into the APV valve system housing and including a pilot retaining bolt, for use with the APV system for foundation tooling constructed in accordance with the present invention.

FIG. 25 depicts another alternate pilot point tip head drilling tool 420 mounted on an elongated pilot shaft comprising an upper pilot shaft section 422 and a lower pilot shaft section 424 structured to be inserted into, and work in conjunction with, the APV valve system housing (see description above) for foundation tooling constructed in accordance with the present invention. Located on the upper pilot shaft section 422 is a retaining bolt 426 and a retainer bolt or pin hole 428. On the lower pilot shaft section 424 this drilling tool is configured with a drilling head 430 having a plurality of cutter bits 432 removably affixed thereon. Also visible in this view is the cutter bit punch out hole 434 which facilitates the replacement of worn cutter bits.

Figure 26:
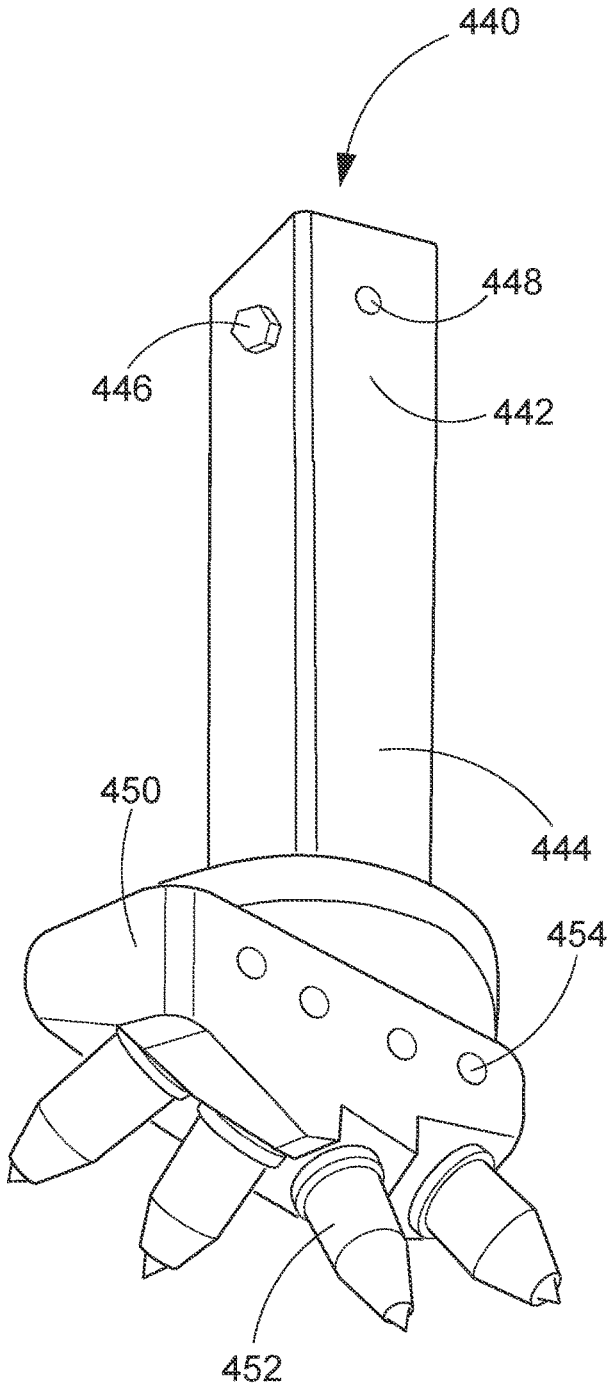
FIG. 26 depicts another alternate pilot point tip head mounted on a pilot shaft structured to be inserted into the APV valve system housing and including a pilot retaining bolt, for use with the APV system for foundation tooling constructed in accordance with the present invention.

FIG. 26 depicts another alternate pilot point tip head drilling tool 440 mounted on an elongated pilot shaft comprising an upper pilot shaft section 442 and a lower pilot shaft section 444 structured to be inserted into, and work in conjunction with, the APV valve system housing (see description above) for foundation tooling constructed in accordance with the present invention. Located on the upper pilot shaft section 442 is a retaining bolt 446 and a retainer bolt or pin hole 448. On the lower pilot shaft section 444 this drilling tool is configured with a drilling head 450 having a plurality of cutter bits 452 removably affixed thereon. Also visible in this view is the cutter bit punch out hole 454 which facilitates the replacement of worn cutter bits.

Figure 27:
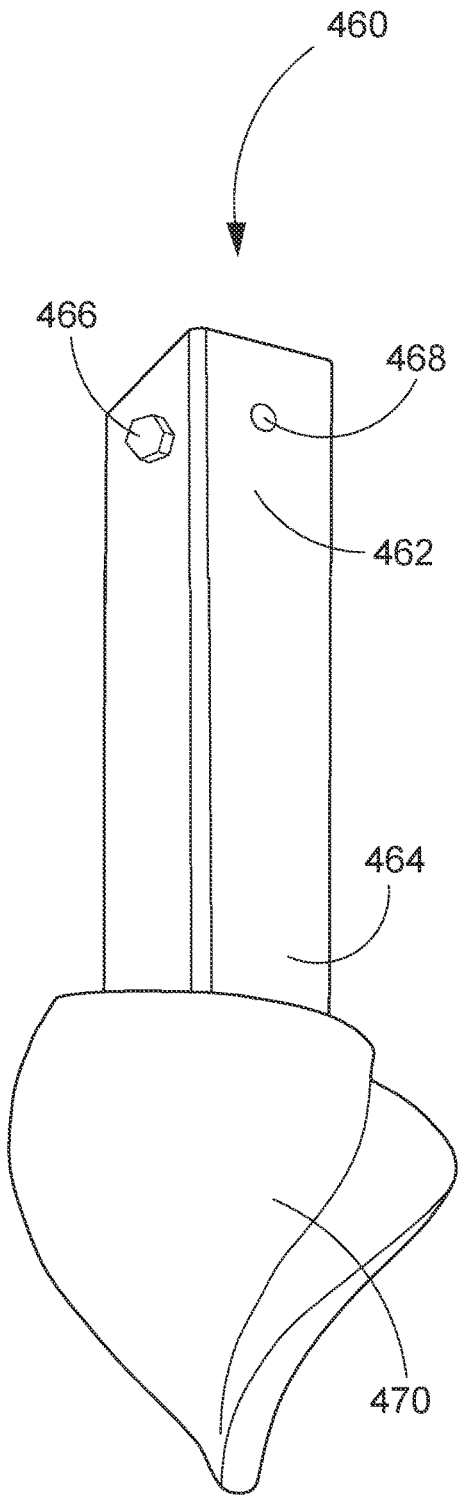
FIG. 27 depicts another alternate pilot point tip head mounted on a pilot shaft structured to be inserted into the APV valve system housing and including a pilot retaining bolt, for use with the APV system for foundation tooling constructed in accordance with the present invention.

FIG. 27 depicts another alternate pilot point tip head drilling tool 460 mounted on an elongated pilot shaft comprising an upper pilot shaft section 462 and a lower pilot shaft section 464 structured to be inserted into, and work in conjunction with, the APV valve system housing (see description above) for foundation tooling constructed in accordance with the present invention. Located on the upper pilot shaft section 462 is a retaining bolt 466 and a retainer bolt or pin hole 468. On the lower pilot shaft section 464 this drilling tool is configured with a singular drilling head 470 having an integrated singular cutter bit 470 permanently affixed thereon.

FIGS. 28-32 depict the five stages 500 of the method in which a continuous flight auger (CFA) is used to drill and construct a piles with partial soil removal which generates lateral soil compression. The five stages 500 are summarized as follows: Stage 1—the drilling stage; Stage 2 drilling is complete and the design depth is reached; Stage 3—auger withdrawal and simultaneous cement injection; Stage 4—cement injection completed up to the borehole mouth; and Stage 5—reinforcement cage positioning. Each of these five stages 500 are described in greater detail below as being performed by utilization of the APV system for foundation tooling constructed in accordance with the present invention.

Figures 28, 29, 30, 31, 32:
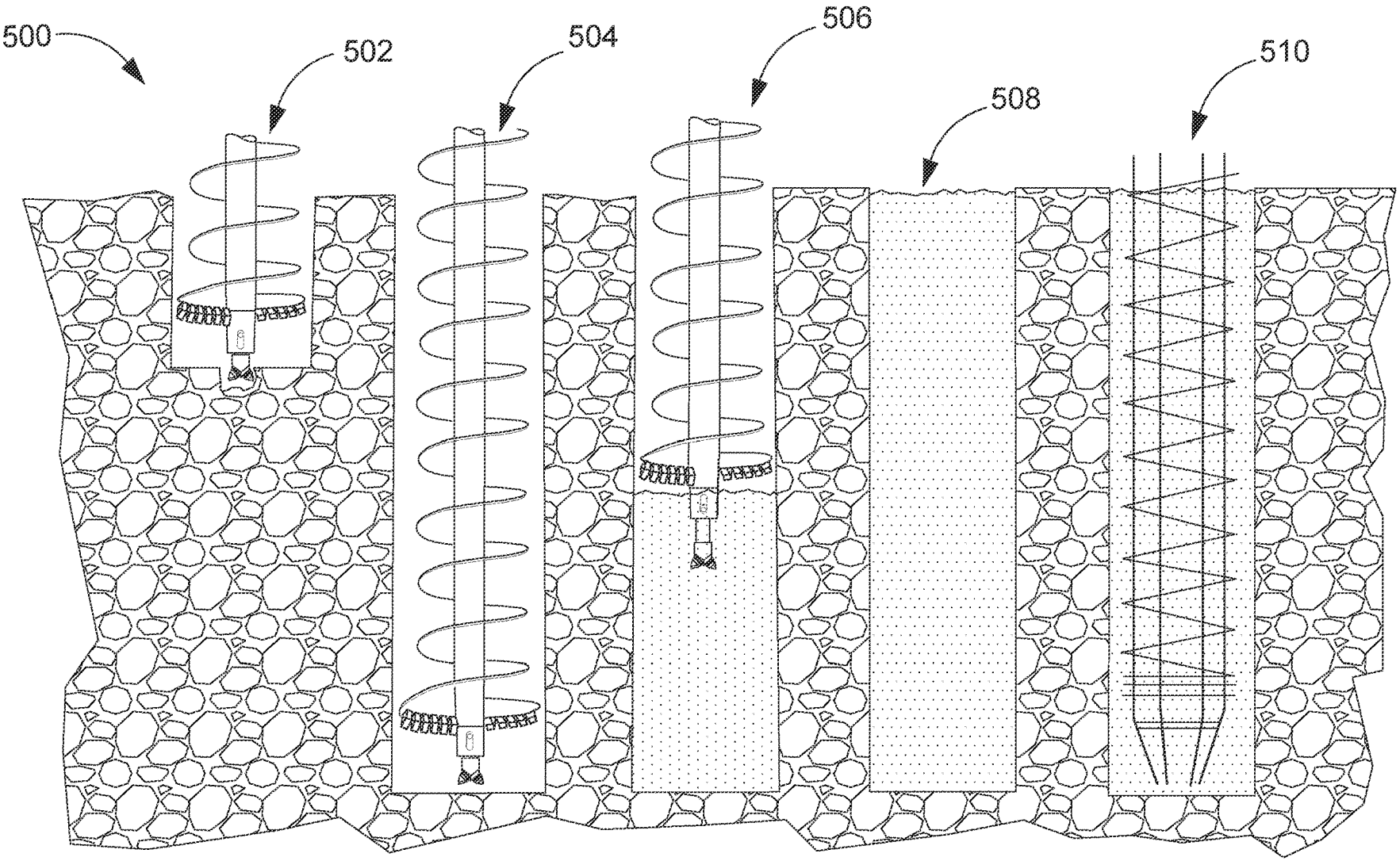
FIG. 28 depicts a side elevational view of the APV system within a cross-sectional view of the earth, illustrating the APV system for foundation tooling in use and engaged in the Stage 1 or drilling phase wherein the APV equipped CFA is drilling down into the ground.
FIG. 29 depicts a side elevational view of the APV system within a cross-sectional view of the earth, illustrating the APV system for foundation tooling in use and engaged in the Stage 2 or end drilling phase wherein the APV equipped CFA is drilling down into the ground and has reached the design depth.
FIG. 30 depicts a side elevational view of the APV system within a cross-sectional view of the earth, illustrating the APV system for foundation tooling in use and engaged in the Stage 3 or the CFA withdrawal phase with simultaneous cement injection.
FIG. 31 depicts a cross-sectional view of the earth in which the APV system for foundation tooling has completed the drilling of the hole and completed Stage 4 or the complete CFA withdrawal and cement injection phase in which the drilled hole is now filled with cement.
FIG. 32 depicts a cross-sectional view of the earth in which the APV system for foundation tooling has completed the drilling of the hole and withdrawal of the CFA and has completed optional Stage 5 or the optional placement and positioning of a reinforcement cage within the drilled hole which is has been filled with cement.

FIG. 28 depicts a side elevational view of the APV system within a cross-sectional view of the earth, illustrating the APV system for foundation tooling in use and engaged in the Stage 1 or drilling phase 502 wherein the APV equipped CFA is drilling down into the ground.

FIG. 29 depicts a side elevational view of the APV system within a cross-sectional view of the earth, illustrating the APV system for foundation tooling in use and engaged in the Stage 2 or end drilling phase 504 wherein the APV equipped CFA is drilling down into the ground and has reached the design depth.

FIG. 30 depicts a side elevational view of the APV system within a cross-sectional view of the earth, illustrating the APV system for foundation tooling in use and engaged in the Stage 3 or the CFA withdrawal phase 506 with simultaneous cement injection.

FIG. 31 depicts a cross-sectional view of the earth in which the APV system for foundation tooling has completed the drilling of the hole and completed Stage 4 or the complete CFA withdrawal and cement injection phase 508 in which the drilled hole is now filled with cement.

FIG. 32 depicts a cross-sectional view of the earth in which the APV system for foundation tooling has completed the drilling of the hole and withdrawal of the CFA and has completed optional Stage 5 or the optional placement and positioning of a reinforcement cage phase 510 within the drilled hole which has been filled with cement.

Figure 33:
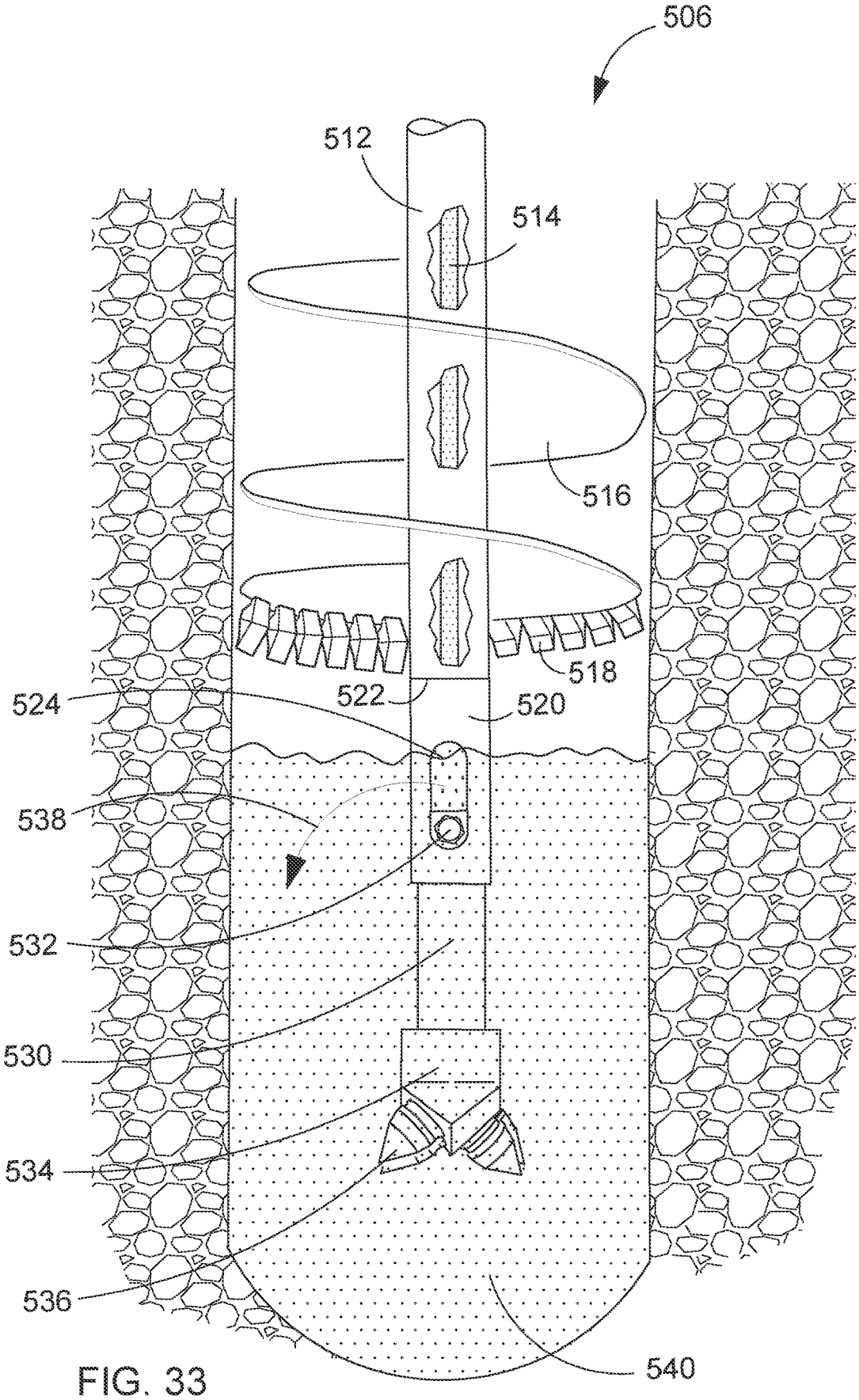
FIG. 33 depicts an enlargement of FIG. 30 in which the APV and CFA are being withdrawn from the drilled hole while simultaneously injecting cement into the hole as the APV equipped CFA is being lifted.

FIG. 33 depicts an enlarged partial cut away view of FIG. 30 in the performance of Stage 3 506 in which the APV system (connected to the CFA) and the CFA are being withdrawn from the drilled hole while simultaneously injecting cement into the hole as the APV equipped CFA is being lifted. As seen in this detailed view, the CFA is structured to include an auger stem 512 having a centrally located cement supply pipe 514 and auger flights 516. The APV system valve housing 520 is affixed to the auger stem 512 by the welded connection 522. The pilot shaft 530 has a retainer bolt 532 on its upper section and a pilot tip 534 equipped with a plurality of cutter bits 536 on its lower section. Additionally, the CFA flight 516 is equipped with cutting teeth 518. Since the CFA and APV system is being lifted, the pilot shaft 530 is automatically fully extended downward by gravity such that the valve port opening 524 in the APV system valve housing 520 is automatically fully open allowing cement 540 to flow from the cement supply pipe 514 down through the valve port opening 524 and into the drilled hole (see direction arrow 538). In this way, the APV system of the present invention is automatically closed during drilling operations by the downward forces placed on it, then is automatically opened when the auger is lifted by gravitational forces and or cement pressure, thereby allowing the flow of cement into the drilled hole at the appropriate time in the construction of piles.

In summary, the Automatic Pilot Valve System for Foundation Tooling of the present invention comprises: (a) a pilot valve housing structured to be secured to an auger stem having an optional cement supply pipe located within said auger stem, wherein said pilot valve housing defines an interior channel configured for accepting a pilot shaft and wherein said pilot valve housing includes one or more openings therein; (b) a pilot shaft having an upper pilot shaft section and a lower pilot shaft section configured to be moveably inserted into said pilot valve housing; (c) a one or more retaining bolts located in said upper pilot shaft section and securely affixed to said upper pilot shaft section wherein said one or more retaining bolts are structured to extend into said one or more openings located in said pilot valve housing and thereby limit the travel of said pilot shaft within said pilot valve housing; and (d) a pilot tip having one or more cutter bits affixed thereto, located in said lower pilot shaft section; wherein when the automatic pilot valve system for foundation tooling is drilling down into an earth soil hole the upper pilot shaft section is pressed up against the auger system and closes off the cement supply and covers said one or more openings in said pilot valve housing to prevent the flow of cement into the drilled hole, and further wherein when said automatic pilot valve system for foundation tooling is being lifted out of the drilled earth soil hole the pilot shaft extends downwardly to open up the cement supply and allows the cement to flow out of the one or more openings in said pilot valve housing, thereby automatically filling the drilled hole with cement.

The Automatic Pilot Valve System for Foundation Tooling primary features will include as prominent design and operational features: (1) the APV of the present invention can be constructed of a one-piece machined, forged or cast frame valve housing or a multi-piece welded or machined constructed interior frame valve housing; (2) the APV of the present invention can be mounted to a foundation tool externally or installed internally; (3) the APV of the present invention includes one or more valve port openings and one or more pilot assembly retainer bolts; (4) the APV of the present invention automatically shifts from a closed position while drilling to an open position while lifting to allow cement to flow into the drilled hole; (5) the APV of the present invention includes one or more pilot locking bolt holes and one or more pilot locking holes; (6) the APV of the present invention includes a pilot assembly with a pilot shaft structured to block the flow of cement when drilling operations are underway, and to allow the cement to flow out of the APV system when being lifted out of the drilled hole; and (7) the APV of the present invention can be used with foundation tools, displacement tools and other applicable tools.

The Automatic Pilot Valve System for Foundation Tooling 30, 40, 60, 80, 100, 130, 240 and 340 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Automatic Pilot Valve System for Foundation Tooling 30, 40, 60, 80, 100, 130, 240 and 340 in accordance with the spirit of this disclosure, and such changes, alternations and modifications as would occur to those skilled in the art are considered to be within the scope of this design as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An automatic pilot valve system for foundation tooling comprising:

(a) a pilot valve housing structured to be secured to an auger stem and flights having a cement supply located within said auger stem, wherein said pilot valve housing defines a channel configured for accepting a pilot shaft and wherein said pilot valve housing includes one or more openings therein;

(b) a pilot shaft having an upper pilot shaft section and a lower pilot shaft section structured to be moveably inserted into said pilot valve housing channel configured for accepting a pilot shaft;

(c) a one or more retaining bolts or pins located in said upper pilot shaft section and securely affixed to said upper pilot shaft section wherein said one or more retaining bolts or pins are structured to extend into said one or more openings located in said pilot valve housing and thereby limit the travel of said pilot shaft within said pilot valve housing; and (d) a pilot tip having one or more cutter bits affixed thereto, located in said lower pilot shaft section;

wherein when the automatic pilot valve system for foundation tooling is drilling down into an earth soil hole the upper pilot shaft section is pressed up against the pilot valve housing and closes off said cement supply and covers said one or more openings in said pilot valve housing to prevent the flow of cement into the drilled hole, and further wherein when said automatic pilot valve system for foundation tooling is being lifted out of the drilled earth soil hole the pilot shaft extends downwardly to open up the cement supply and allows the cement to flow out of the one or more openings in said pilot valve housing, thereby automatically filling the drilled hole with cement.

2. The automatic pilot valve system for foundation tooling according to claim 1, wherein said pilot valve housing is constructed of a one-piece machined, forged or cast frame valve housing.

3. The automatic pilot valve system for foundation tooling according to claim 2, wherein said one-piece machined, forged or cast frame valve housing is affixed externally to a continuous flight auger stem foundation tooling or a displacement tool.

4. The automatic pilot valve system for foundation tooling according to claim 1, wherein said pilot valve housing is constructed of a multi-piece welded or machined frame valve housing.

5. The automatic pilot valve system for foundation tooling according to claim 4, wherein said multi-piece welded or machined frame valve housing is affixed internally to a continuous flight auger stem foundation tooling or a displacement tool.

6. The automatic pilot valve system for foundation tooling according to claim 1, wherein said one or more retaining bolts further include one or more retaining bolt washers.

7. The automatic pilot valve system for foundation tooling according to claim 1, wherein said auger stem and flights further include cutting teeth affixed to said flights structured to assist in drilling in difficult ground.

8. The automatic pilot valve system for foundation tooling according to claim 1, wherein said lower pilot shaft further includes an affixed pilot tip having one or more removably affixed cutter bits.

9. The automatic pilot valve system for foundation tooling according to claim 8, wherein said one or more removably affixed cutter bits further include corresponding cutter bit punch out removal holes.

10. The automatic pilot valve system for foundation tooling according to claim 1, further including a drive bar, a drive connector having a locking slot therein, a gusset bracing the drive connector to the auger flighting, and an upper valve port opening cut out of the auger stem, structured to prevent hydraulic locking and suction when drilled holes are filled with fluid.

11. The method of making an automatic pilot valve system for foundation tooling, comprising the steps of:

(a) providing a pilot valve housing structured to be secured to an auger stem and flights having a cement supply located within said auger stem, wherein said pilot valve housing defines a channel configured for accepting a pilot shaft and wherein said pilot valve housing includes one or more openings therein;

(b) providing a pilot shaft having an upper pilot shaft section and a lower pilot shaft section structured to be moveably inserted into said pilot valve housing channel configured for accepting a pilot shaft;

(c) providing one or more retaining bolts or pins located in said upper pilot shaft section and securely affixed to said upper pilot shaft section wherein said one or more retaining bolts or pins are structured to extend into said one or more openings located in said pilot valve housing and thereby limit the travel of said pilot shaft within said pilot valve housing; and (d) providing a pilot tip having one or more cutter bits affixed thereto, located in said lower pilot shaft section;

wherein when the automatic pilot valve system for foundation tooling is drilling down into an earth soil hole the upper pilot shaft section is pressed up against the pilot valve housing and closes off said cement supply and covers said one or more openings in said pilot valve housing to prevent the flow of cement into the drilled hole, and further wherein when said automatic pilot valve system for foundation tooling is being lifted out of the drilled earth soil hole the pilot shaft extends downwardly to open up the cement supply and allows the cement to flow out of the one or more openings in said pilot valve housing, thereby automatically filling the drilled hole with cement.

12. The method for making an automatic pilot valve system for foundation tooling according to claim 11, wherein said pilot valve housing is constructed of a one-piece machined, forged or cast frame valve housing.

13. The method for making an automatic pilot valve system for foundation tooling according to claim 12, wherein said one-piece machined, forged or cast frame valve housing is affixed externally to a continuous flight auger stem.

14. The method for making an automatic pilot valve system for foundation tooling according to claim 11, wherein said pilot valve housing is constructed of a multi-piece welded or machined frame valve housing.

15. The method for making an automatic pilot valve system for foundation tooling according to claim 14, wherein said multi-piece welded or machined frame valve housing is affixed internally to a continuous flight auger stem.

16. The method for making an automatic pilot valve system for foundation tooling according to claim 11, wherein said one or more retaining bolts further include one or more retaining bolt washers.

17. The method for making an automatic pilot valve system for foundation tooling according to claim 11, wherein said auger stem and flights further include cutting teeth affixed to said flights structured to assist in drilling in difficult ground.

18. The method for making an automatic pilot valve system for foundation tooling according to claim 11, wherein said lower pilot shaft further includes an affixed pilot tip having one or more removably affixed cutter bits.

19. The method for making an automatic pilot valve system for foundation tooling according to claim 18, wherein said one or more removably affixed cutter bits further include corresponding cutter bit punch out removal holes.

20. The method for making an automatic pilot valve system for foundation tooling according to claim 11, further including a drive bar, a drive connector having a locking slot therein, a gusset bracing the drive connector to the auger flighting, and an upper valve port opening cut out of the auger stem, structured to prevent hydraulic locking and suction when drilled holes are filled with fluid.

* * * * *